US010099834B2

(12) United States Patent
Melrose

(10) Patent No.: US 10,099,834 B2
(45) Date of Patent: Oct. 16, 2018

(54) PRESSURE CONTAINER WITH DIFFERENTIAL VACUUM PANELS

(75) Inventor: David Murray Melrose, Auckland (NZ)

(73) Assignee: DAVID MELROSE DESIGN LTD, Auckland (NZ)

( * ) Notice: Subject to any disclaimer, the term of this patent is extended or adjusted under 35 U.S.C. 154(b) by 1292 days.

(21) Appl. No.: 13/270,886

(22) Filed: Oct. 11, 2011

(65) Prior Publication Data

US 2012/0273453 A1 Nov. 1, 2012

Related U.S. Application Data

(63) Continuation of application No. 11/664,265, filed as application No. PCT/US2005/035241 on Sep. 30, 2005, now Pat. No. 8,186,528.

(30) Foreign Application Priority Data

Sep. 30, 2004 (NZ) ..... 535722

(51) Int. Cl.
*B65D 79/00* (2006.01)
*B65D 1/02* (2006.01)

(52) U.S. Cl.
CPC ..... *B65D 79/005* (2013.01); *B65D 1/0223* (2013.01); *B65D 2501/0027* (2013.01);
(Continued)

(58) Field of Classification Search
USPC ..... 220/669, 675; 215/381, 382, 383, 384
See application file for complete search history.

(56) References Cited

U.S. PATENT DOCUMENTS

D191,069 S 8/1961 Schacher
3,325,031 A 6/1967 Singier
(Continued)

FOREIGN PATENT DOCUMENTS

AU 2005202086 11/2006
EP 1431190 A1 6/2004
(Continued)

OTHER PUBLICATIONS

"And Constar Makes Three in the Hot-Fill, Panel-Less Bottle Race Packaging Strategies," Aug. 31, 2005, p. 5 (www.packstrat.com).
(Continued)

*Primary Examiner* — James N Smalley
*Assistant Examiner* — Madison L Poos
(74) *Attorney, Agent, or Firm* — Henricks Slavin LLP

(57) ABSTRACT

An improved blow molded plastic container having generally rounded sidewalls that are adapted for hot-fill applications has two adjacent sides and two pairs of controlled deflection panels, each pair reacting to vacuum pressure at differing rates of movement, whereby one pair inverts under vacuum pressure and the other pair remains available for increased squeezability or extreme vacuum extraction. The opposing sidewalls are symmetric relative to vacuum panel and rib shape and placement. The ribs and controlled deflection panels cooperate to retain container shape upon filling and cooling and also improves bumper denting resistance, decreases vacuum pressure within the container, and increases light weight capability.

24 Claims, 24 Drawing Sheets

(52) U.S. Cl.
CPC ..... *B65D 2501/0036* (2013.01); *B65D 2501/0081* (2013.01)

(56) References Cited

U.S. PATENT DOCUMENTS

| | | | | |
|---|---|---|---|---|
| 3,536,500 | A | 10/1970 | Cleereman et al. | |
| D234,911 | S | 4/1975 | Stevens, Jr. | |
| 3,923,178 | A | 12/1975 | Welker, III | |
| D263,026 | S | 2/1982 | Beechuk et al. | |
| 4,372,455 | A | 2/1983 | Cochran | |
| 4,497,855 | A | 2/1985 | Agrawal | |
| 4,805,788 | A | 2/1989 | Akiho | |
| 4,877,141 | A | 10/1989 | Hayashi et al. | |
| 4,946,053 | A | 8/1990 | Conrad | |
| 5,092,474 | A | 3/1992 | Leigner | |
| 5,101,990 | A | 4/1992 | Krishnakumar et al. | |
| 5,178,290 | A | 1/1993 | Ota et al. | |
| D335,455 | S | 5/1993 | Brown | |
| 5,226,538 | A | 7/1993 | Roselle | |
| 5,238,129 | A | 8/1993 | Ota et al. | |
| 5,303,834 | A | 4/1994 | Krishnakumar et al. | |
| 5,330,054 | A | 7/1994 | Brown | |
| 5,337,909 | A | 8/1994 | Vailliencourt | |
| 5,472,105 | A | 12/1995 | Krishnakumar et al. | |
| 5,690,244 | A | 11/1997 | Darr | |
| D399,391 | S | 10/1998 | Malvasi et al. | |
| 5,971,184 | A * | 10/1999 | Krishnakumar et al. | 215/384 |
| 6,044,996 | A | 4/2000 | Carew et al. | |
| D435,453 | S | 12/2000 | Krishnakumar et al. | |
| D436,042 | S | 1/2001 | Krishnakumar et al. | |
| D436,043 | S | 1/2001 | Krishnakumar et al. | |
| D442,492 | S | 5/2001 | Krishnakumar et al. | |
| D446,730 | S | 8/2001 | Adee et al. | |
| D462,273 | S | 9/2002 | Crawford | |
| D466,414 | S | 12/2002 | Venkataraman et al. | |
| 6,494,333 | B2 | 12/2002 | Sasaki et al. | |
| 6,513,669 | B2 | 2/2003 | Ozawa et al. | |
| 6,637,613 | B2 | 10/2003 | Shimada et al. | |
| D482,976 | S | 12/2003 | Melrose | |
| 6,739,467 | B2 | 5/2004 | Saito et al. | |
| 6,837,390 | B2 | 1/2005 | Lane et al. | |
| 6,920,992 | B2 * | 7/2005 | Lane et al. | 215/381 |
| 6,935,525 | B2 | 8/2005 | Trude | |
| 7,014,056 | B2 | 3/2006 | Trude | |
| D522,870 | S | 6/2006 | Venkataraman et al. | |
| D525,529 | S | 7/2006 | Oguchi et al. | |
| 7,073,675 | B2 | 7/2006 | Trude | |
| 7,118,002 | B2 | 10/2006 | Saito et al. | |
| 7,137,520 | B1 | 11/2006 | Melrose | |
| D533,785 | S | 12/2006 | Corbett et al. | |
| D535,884 | S | 1/2007 | Davis | |
| D536,255 | S | 2/2007 | Corbett et al. | |
| D538,168 | S | 3/2007 | Davis et al. | |
| 7,191,910 | B2 | 3/2007 | Deemer et al. | |
| 7,198,164 | B2 | 4/2007 | Yourist | |
| D542,666 | S | 5/2007 | Trude | |
| 7,213,719 | B2 | 5/2007 | Pedmo et al. | |
| D547,664 | S | 7/2007 | Davis et al. | |
| 7,296,702 | B2 | 11/2007 | Tanaka et al. | |
| 7,377,399 | B2 | 5/2008 | Lane et al. | |
| 7,416,090 | B2 | 8/2008 | Mooney et al. | |
| 7,455,189 | B2 | 11/2008 | Lane et al. | |
| 7,458,478 | B2 | 12/2008 | Kamineni | |
| 7,472,798 | B2 | 1/2009 | Stowitts | |
| 7,810,664 | B2 | 10/2010 | Trude | |
| 8,087,525 | B2 | 1/2012 | Kelley et al. | |
| 8,109,398 | B2 | 2/2012 | Lewis | |
| 8,186,528 | B2 | 5/2012 | Melrose | |
| 2001/0022291 | A1 | 9/2001 | Shimada et al. | |
| 2001/0035392 | A1 | 11/2001 | Ota et al. | |
| 2001/0054597 | A1 | 12/2001 | Tomoyuki et al. | |
| 2002/0000421 | A1 | 1/2002 | Ota et al. | |
| 2002/0008077 | A1 * | 1/2002 | Lane et al. | 215/381 |
| 2002/0092821 | A1 | 7/2002 | Saito et al. | |
| 2003/0136754 | A1 | 7/2003 | Bourque et al. | |
| 2003/0205550 | A1 | 11/2003 | Prevot et al. | |
| 2004/0016716 | A1 | 1/2004 | Melrose et al. | |
| 2004/0200799 | A1 | 10/2004 | Yourist | |
| 2005/0067369 | A1 | 3/2005 | Trude | |
| 2005/0121408 | A1 * | 6/2005 | Deemer et al. | 215/381 |
| 2005/0139572 | A1 | 6/2005 | Pedmo et al. | |
| 2005/0218107 | A1 | 10/2005 | Sabold et al. | |
| 2005/0218108 | A1 | 10/2005 | Bangi et al. | |
| 2006/0065618 | A1 | 3/2006 | Pedmo et al. | |
| 2006/0070977 | A1 | 4/2006 | Howell et al. | |
| 2006/0076310 | A1 | 4/2006 | Mooney et al. | |
| 2006/0157439 | A1 | 7/2006 | Howell | |
| 2006/0180568 | A1 | 8/2006 | Lane | |
| 2007/0075032 | A1 | 4/2007 | Kelley et al. | |
| 2007/0090083 | A1 | 4/2007 | Trude | |
| 2007/0125743 | A1 | 6/2007 | Pritchett et al. | |
| 2007/0187355 | A1 | 8/2007 | Kamineni | |
| 2007/0210028 | A1 | 9/2007 | Heisner et al. | |
| 2007/0257004 | A1 | 11/2007 | Howell et al. | |
| 2008/0257856 | A1 | 10/2008 | Melrose et al. | |
| 2010/0301003 | A1 | 12/2010 | Lewis | |
| 2012/0160857 | A1 | 6/2012 | Melrose | |

FOREIGN PATENT DOCUMENTS

| | | | |
|---|---|---|---|
| JP | 64-004662 | Y2 | 2/1989 |
| JP | 4-10012 | A | 1/1992 |
| JP | 3056271 | B | 2/1999 |
| JP | 2001-048147 | A | 2/2001 |
| JP | 2001-106217 | A | 4/2001 |
| JP | 2002-160717 | A | 6/2002 |
| JP | 2002-537195 | A | 11/2002 |
| NZ | 239179 | | 5/2000 |
| NZ | 513783 | | 12/2003 |
| NZ | 516023 | | 4/2004 |
| NZ | 554532 | | 4/2007 |
| NZ | 535722 | | 8/2007 |
| WO | WO-97-34808 | | 9/1997 |
| WO | WO-00/50309 | A | 8/2000 |
| WO | WO-2000/68095 | | 11/2000 |
| WO | WO-2005/067419 | A2 | 3/2005 |
| WO | WO-2006/039523 | A1 | 4/2006 |
| WO | WO2007/041422 | | 4/2007 |
| WO | WO2008/127130 | | 4/2008 |

OTHER PUBLICATIONS

International Search Report dated Feb. 8, 2006, issued for PCT/US2005/035241.
USPTO, File History for U.S. Appl. No. 11/529,486, filed Sep. 29, 2006, published as US2007/0075032.
USPTO, File History for U.S. Appl. No. 11/529,487, filed Sep. 29, 2006, published as US2007/0090083.
USPTO, File History for U.S. Appl. No. 11/664,265, filed Jun. 16, 2008, published as US2008/0257856.
USPTO, File History for U.S. Appl. No. 12/476,350, filed Jun. 2, 2009, published as US2010/0301003.
USPTO, File History for U.S. Appl. No. 12/595,830, filed Oct. 13, 2009, published as US20100116778.
USPTO, File History for U.S. Appl. No. 13/357,232, filed Jan. 24, 2010, published as US20120160857.
USPTO, File History for U.S. Appl. No. 14/106,703, filed Dec. 13, 2013.
International Search Report dated Apr. 12, 2007 for WO/2007/041422, WIPO.
International Search Report dated Feb. 8, 2006 for WO/2006/039523, WIPO.
International Search Report dated Oct. 23, 2008 for WO2008/127130, WIPO.
Japanese Office Action dated Jul. 23, 2013, issued in related Japanese Patent Application No. 2012-114249, and an English-language translation.

* cited by examiner

PRESSURE CONTAINER WITH DIFFERENTIAL VACUUM PANELS

CROSS REFERENCE TO RELATED APPLICATIONS

This application is continuation of Ser. No. 11/664,265 filed Jun. 16, 2008, now U.S. Pat. No. 8,186,528 granted May 29, 2012, the contents of which are incorporated herein by reference, and which is a National Stage of International Application PCT/US2005/035241 filed Sep. 30, 2005, which claims priority to NZ535722 filed Sep. 30, 2004.

BACKGROUND OF THE INVENTION

Field of the Invention

The present invention relates generally to plastic containers, and more particularly to hot-fillable containers having collapse or vacuum panels.

Statement of the Prior Art

Hot-fill applications impose significant and complex mechanical stress on a container structure due to thermal stress, hydraulic pressure upon filling and immediately after capping, and vacuum pressure as the fluid cools.

Thermal stress is applied to the walls of the container upon introduction of hot fluid. The hot fluid causes the container walls to soften and then shrink unevenly, further causing distortion of the container. The plastic walls of the container—typically made of polyester—may, thus, need to be heat-treated in order to induce molecular changes, which would result in a container that exhibits better thermal stability.

Pressure and stress are acted upon the sidewalls of a heat resistant container during the filling process, and for a significant period of time thereafter. When the container is filled with hot liquid and sealed, there is an initial hydraulic pressure and an increased internal pressure is placed upon containers. As the liquid, and the air headspace under the cap, subsequently cool, thermal contraction results in partial evacuation of the container. The vacuum created by this cooling tends to mechanically deform the container walls.

Generally speaking, containers incorporating a plurality of longitudinal flat surfaces accommodate vacuum force more readily. U.S. Pat. No. 4,497,855 (Agrawal et al.), for example, discloses a container with a plurality of recessed collapse panels, separated by land areas, which purportedly allow uniformly inward deformation under vacuum force. Vacuum effects are allegedly controlled without adversely affecting the appearance of the container. The panels are said to be drawn inwardly to vent the internal vacuum and so prevent excess force being applied to the container structure, which would otherwise deform the inflexible post or land area structures. The amount of "flex" available in each panel is limited, however, and as the limit is approached there is an increased amount of force that is transferred to the sidewalls.

To minimize the effect of force being transferred to the sidewalls, much prior art has focused on providing stiffened regions to the container, including the panels, to prevent the structure yielding to the vacuum force.

The provision of horizontal or vertical annular sections, or "ribs", throughout a container has become common practice in container construction, and is not only restricted to hot-fill containers. Such annular sections will strengthen the part they are deployed upon. U.S. Pat. No. 4,372,455 (Cochran), for example, discloses annular rib strengthening in a longitudinal direction, placed in the areas between the flat surfaces that are subjected to inwardly deforming hydrostatic forces under vacuum force. U.S. Pat. No. 4,805,788 (Ota et al.) discloses longitudinally extending ribs alongside the panels to add stiffening to the container. It also discloses the strengthening effect of providing a larger step in the sides of the land areas, which provides greater dimension and strength to the rib areas between the panels. U.S. Pat. No. 5,178,290 (Ota et al.) discloses indentations to strengthen the panel areas themselves. Finally, U.S. Pat. No. 5,238,129 (Ota et al.) discloses further annular rib strengthening, this time horizontally directed in strips above and below, and outside, the hot-fill panel section of the bottle.

In addition to the need for strengthening a container against both thermal and vacuum stress, there is a need to allow for an initial hydraulic pressure and increased internal pressure that is placed upon a container when hot liquid is introduced followed by capping. This causes stress to be placed on the container side wall. There is a forced outward movement of the heat panels, which can result in a barreling of the container.

Thus, U.S. Pat. No. 4,877,141 (Hayashi et al.) discloses a panel configuration that accommodates an initial, and natural, outward flexing caused by internal hydraulic pressure and temperature, followed by inward flexing caused by the vacuum formation during cooling. Importantly, the panel is kept relatively flat in profile, but with a central portion displaced slightly to add strength to the panel but without preventing its radial movement in and out. With the panel being generally flat, however, the amount of movement is limited in both directions. By necessity, panel ribs are not included for extra resilience, as this would prohibit outward and inward return movement of the panel as a whole.

As stated above, the use of blow molded plastic containers for packaging "hot-fill" beverages is well known. However, a container that is used for hot-fill applications is subject to additional mechanical stresses on the container that result in the container being more likely to fail during storage or handling. For example, it has been found that the thin sidewalls of the container deform or collapse as the container is being filled with hot fluids. In addition, the rigidity of the container decreases immediately after the hot-fill liquid is introduced into the container. As the liquid cools, the liquid shrinks in volume which, in turn, produces a negative pressure or vacuum in the container. The container must be able to withstand such changes in pressure without failure.

Hot-fill containers typically comprise substantially rectangular vacuum panels that are designed to collapse inwardly after the container has been filled with hot liquid. However, the inward flexing of the panels caused by the hot-fill vacuum creates high stress points at the top and bottom edges of the vacuum panels, especially at the upper and lower corners of the panels. These stress points weaken the portions of the sidewall near the edges of the panels, allowing the sidewall to collapse inwardly during handling of the container or when containers are stacked together. See, e.g., U.S. Pat. No. 5,337,909.

The presence of annular reinforcement ribs that extend continuously around the circumference of the container sidewall are shown in U.S. Pat. No. 5,337,909. These ribs are indicated as supporting the vacuum panels at their upper and lower edges. This holds the edges fixed, while permitting the center portions of the vacuum panels to flex inwardly while the bottle is being filled. These ribs also resist the deformation of the vacuum panels. The reinforcement ribs can merge with the edges of the vacuum panels at the edge of the label upper and lower mounting panels.

Another hot-fill container having reinforcement ribs is disclosed in WO 97/34808. The container comprises a label mounting area having an upper and lower series of peripherally spaced, short, horizontal ribs separated endwise by label mount areas. It is stated that each upper and lower rib is located within the label mount section and is centered above or below, respectively, one of the lands. The container further comprises several rectangular vacuum panels that also experience high stress point at the corners of the collapse panels. These ribs stiffen the container adjacent lower corners of the collapse panels.

Stretch blow molded containers such as hot-filled PET juice or sport drink containers, must be able to maintain their function, shape and labelability on cool down to room temperature or refrigeration. In the case of non-round containers, this is more challenging due to the fact that the level of orientation and, therefore, crystallinity is inherently lower in the front and back than on the narrower sides. Since the front and back are normally where vacuum panels are located, these areas must be made thicker to compensate for their relatively lower strength.

The reference to any prior art in the specification is not, and should not be taken as any acknowledgement or any form of suggestion that the prior art forms part of the common general knowledge in any country or region.

SUMMARY OF THE INVENTION

The present invention provides an improved blow molded plastic container, where a controlled deflection flex panel is placed on one sidewall of a container and a second controlled deflection flex panel having a different response to vacuum pressure is placed on an alternate sidewall. By way of example, a container having four controlled deflection flex panels may be disposed in two pairs on symmetrically opposing sidewalls, whereby one pair of controlled deflection flex panels responds to vacuum force at a different rate to an alternatively positioned pair. The pairs of controlled deflection flex panels may be positioned an equidistance from the central longitudinal axis of the container, or may be positioned at differing distances from the centerline of the container. In addition the design allows for a more controlled overall response to vacuum pressure and improved dent resistance and resistance to torsion displacement of post or land areas between the panels. Further, improved reduction in container weight is achieved, along with potential for development of squeezable container designs.

One preferred form of the invention provides a container having four controlled deflection flex panels, each having a generally variable outward curvature with respect to the centerline of the container. The first pair of panels is positioned whereby one panel in the first pair is disposed opposite the other, and the first pair of panels has a geometry and surface area that is distinct from the alternately positioned second pair of panels. The second pair of panels is similarly positioned whereby the panels in the second pair are disposed in opposition to each other. The containers are suitable for a variety of uses including hot-fill applications.

In hot-fill applications, the plastic container is filled with a liquid that is above room temperature and then sealed so that the cooling of the liquid creates a reduced volume in the container. In this preferred embodiment, the first pair of opposing controlled deflection flex panels, having the least total surface area between them, have a generally rectangular shape, wider at the base than at the top. These panels may be symmetrical to each other in size and shape. These controlled deflection flex panels have a substantially outwardly curved, transverse profile and an initiator portion toward the central region that is less outwardly curved than in the upper and lower regions. Alternatively, the amount of outward curvature could vary evenly from top to bottom, bottom to top, or any other suitable arrangement. Alternatively, the entire panel may have a relatively even outward curvature but vary in extent of transverse circumferential amount, such that one portion of the panel begins deflection inwardly before another portion of the panel. This first pair of controlled deflection flex panels may in addition contain one or more ribs located above or below the panels. These optional ribs may also be symmetric to ribs, in size, shape and number to ribs on the opposing sidewalls containing the second set of controlled deflection flex panels. The ribs on the second set of controlled deflection flex panels have a rounded edge which may point inward or outward relative to the interior of the container. In a first preferred form of the invention, whereby the first pair of controlled deflection flex panels is preferentially reactive to vacuum forces to a much greater extent initially than the second pair of controlled deflection flex panels, it is preferred to not have ribs incorporated within the first pair of panels, in order to allow easier movement of the panels.

The vacuum panels may be selected so that they are highly efficient. See, e.g., PCT application NO. PCT/NZ00/00019 (Melrose) where panels with vacuum panel geometry are shown. 'Prior art' vacuum panels are generally flat or concave. The controlled deflection flex panel of Melrose of PCT/NZ00/00019 and the present invention is outwardly curved and can extract greater amounts of pressure. Each flex panel has at least two regions of differing outward curvature. The region that is less outwardly curved (i.e., the initiator region) reacts to changing pressure at a lower threshold than the region that is more outwardly curved. By providing an initiator portion, the control portion (i.e., the region that is more outwardly curved) reacts to pressure more readily than would normally happen. Vacuum pressure is thus reduced to a greater degree than prior art causing less stress to be applied to the container sidewalls. This increased venting of vacuum pressure allows for may design options: different panel shapes, especially outward curves; lighter weight containers; less failure under load; less panel area needed; different shape container bodies.

The controlled deflection flex panel can be shaped in many different ways and can be used on inventive structures that are not standard and can yield improved structures in a container.

All sidewalls containing the controlled deflection flex panels may have one or more ribs located within them. The ribs can have either an outer or inner edge relative to the inside of the container. These ribs may occur as a series of parallel ribs. These ribs are parallel to each other and the base. The number of ribs within the series can be either an odd or even. The number, size and shape of ribs are symmetric to those in the opposing sidewall. Such symmetry enhances stability of the container.

Preferably, the ribs on the side containing the second pair of controlled deflection panels and having the largest surface area of panel, are substantially identical to each other in size and shape. The individual ribs can extend across the length or width the container. The actual length, width and depth of the rib may vary depending on container use, plastic material employed and the demands of the manufacturing process. Each rib is spaced apart relative to the others to optimize its and the overall stabilization function as an inward or outward rib. The ribs are parallel to one another and preferably, also to the container base.

The advanced highly efficient design of the controlled deflection panels of the first pair of panels more than compensates for the fact that they offer less surface area than the larger front and back panels. By providing for the first pair of panels to respond to lower thresholds of pressure, these panels may begin the function of vacuum compensation before the second larger panel set, despite being positioned further from the centerline. The second larger panel set may be constructed to move only minimally and relatively evenly in response to vacuum pressure, as even a small movement of these panels provides adequate vacuum compensation due to the increased surface area. The first set of controlled deflection flex panels may be constructed to invert and provide much of the vacuum compensation required by the package in order to prevent the larger set of panels from entering an inverted position. Employment of a thin-walled super light weight preform ensures that a high level of orientation and crystallinity are imparted to the entire package. This increased level of strength together with the rib structure and highly efficient vacuum panels provide the container with the ability to maintain function and shape on cool down, while at the same time utilizing minimum gram weight.

The arrangement of ribs and vacuum panels on adjacent sides within the area defined by upper and lower container bumpers allows the package to be further light weighted without loss of structural strength. The ribs are placed on the larger, non-inverting panels and the smaller inverting panels may be generally free of rib indentations and so are more suitable for embossing or debossing of Brand logos or name. This configuration optimizes geometric orientation of squeeze bottle arrangements, whereby the sides of the container are partially drawn inwardly as the main larger panels contract toward each other. Generally speaking, in prior art as the front and back panels are drawn inwardly under vacuum the sides are forced outwardly. In the present invention the side panels invert toward the centre and maintain this position without being forced outwardly beyond the post structures between the panels. Further, this configuration of ribs and vacuum panel represents a departure from tradition.

These and various other advantages and features of novelty which characterize the invention are pointed out with particularity in the claims annexed hereto and forming a part hereof. However, for a better understanding of the invention, its advantages, and the objects obtained by its use, reference should be made to the drawings which form a further part hereof, and to the accompanying descriptive matter, in which there is illustrated and described a preferred embodiment of the invention.

DETAILED DESCRIPTION OF THE INVENTION

A thin-walled container in accordance with the present invention is intended to be filled with a liquid at a temperature above room temperature. According to the invention, a container may be formed from a plastic material such as polyethylene terephthalate (PET) or polyester. Preferably, the container is blow molded. The container can be filled by automated, high speed, hot-fill equipment known in the art.

Figure 1B:
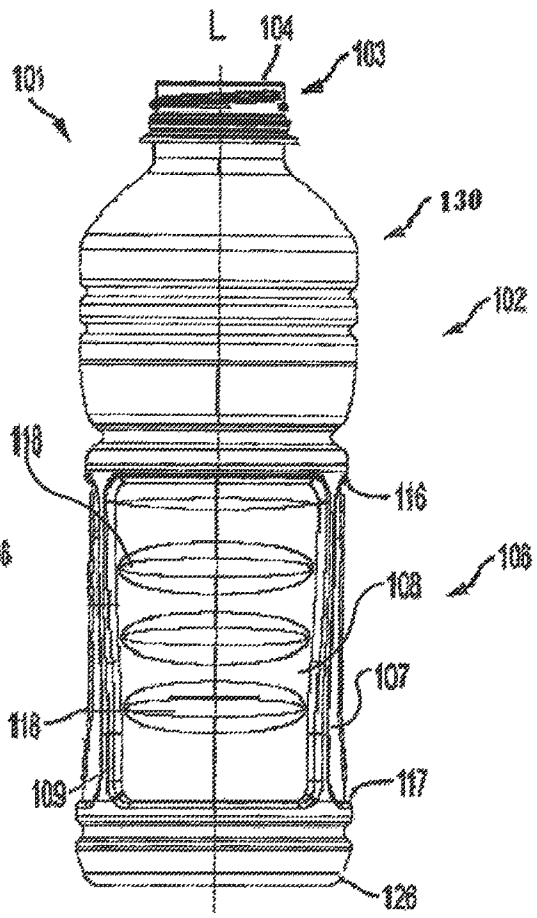
FIGS. 1A and 1B, respectively, show side and front views of a container according to a first embodiment of the present invention.
Figure 1A:
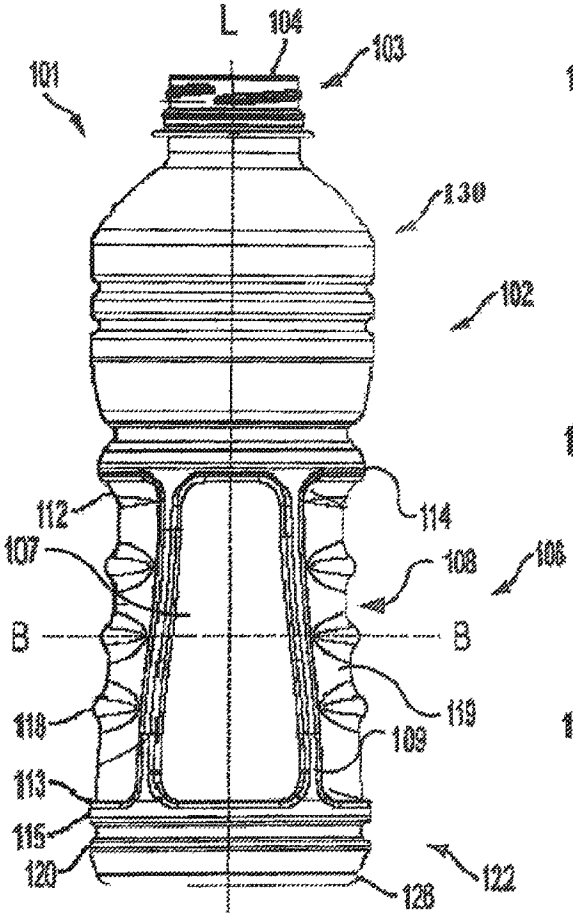

Referring now to the drawings, a first embodiment of the container of the invention is indicated generally in FIGS. 1A and 1B, as generally having many of the well-known features of hot-fill bottles. The container 101, which is generally round or oval in shape, has a longitudinal axis L when the container is standing upright on its base 126. The container 101 comprises a threaded neck 103 for filling and dispensing fluid through an opening 104. Neck 103 also is sealable with a cap (not shown). The preferred container further comprises a roughly circular base 126 and a bell 130 located below neck 103 and above base 126. The container of the present invention also has a body 102 defined by roughly round sides containing a pair of narrower controlled deflection flex panels 107 and a pair of wider controlled deflection flex panels 108 that connect bell 130 and base 126. A label or labels can easily be applied to the bell area 130 using methods that are well known to those skilled in the art, including shrink wrap labeling and adhesive methods. As applied, the label extends either around the entire bell 130 of the container 101 or extends over a portion of the label mounting area.

Generally, the substantially rectangular flex panels 108 containing one or more ribs 118 are those with a width greater than the pair of flex panels adjacent 107 in the body area 102. The placement of the controlled deflection flex panel 108 and the ribs 118 are such that the opposing sides are generally symmetrical. These flex panels 108 have rounded edges at their upper and lower portions 112, 113. The vacuum panels 108 permit the bottle to flex inwardly upon filling with the hot fluid, sealing, and subsequent cooling. The ribs 118 can have a rounded outer or inner edge, relative to the space defined by the sides of the container. The ribs 118 typically extend most of the width of the side and are parallel with each other and the base. The width of these ribs 118 is selected consistent with the achieving the rib function. The number of ribs 118 on either adjacent side can vary depending on container size, rib number, plastic composition, bottle filling conditions and expected contents. The placement of ribs 118 on a side can also vary so long as the desired goals associated with the interfunctioning of the ribbed flex panels and the non-ribbed flex panels is not lost. The ribs 118 are also spaced apart from the upper and lower edges of the vacuum panels, respectively, and are placed to maximize their function. The ribs 118 of each series are noncontinuous, i.e., they do not touch each other. Nor do they touch a panel edge.

The number of vacuum panels 108 is variable. However, two symmetrical panels 108, each on the opposite sides of the container 101, are preferred. The controlled deflection flex panel 108 is substantially rectangular in shape and has a rounded upper edge 112, and a rounded lower edge 113.

As shown in FIGS. 1A and 1B, the narrower side contains the controlled deflection flex panel 107 that does not have rib strengthening. Of course, the panel 107 may also incorporate a number of ribs (not shown) of varying length and configuration. It is preferred, however, that any ribs positioned on this side correspond in positioning and size to their counterparts on the opposite side of the container.

Figure 16A:
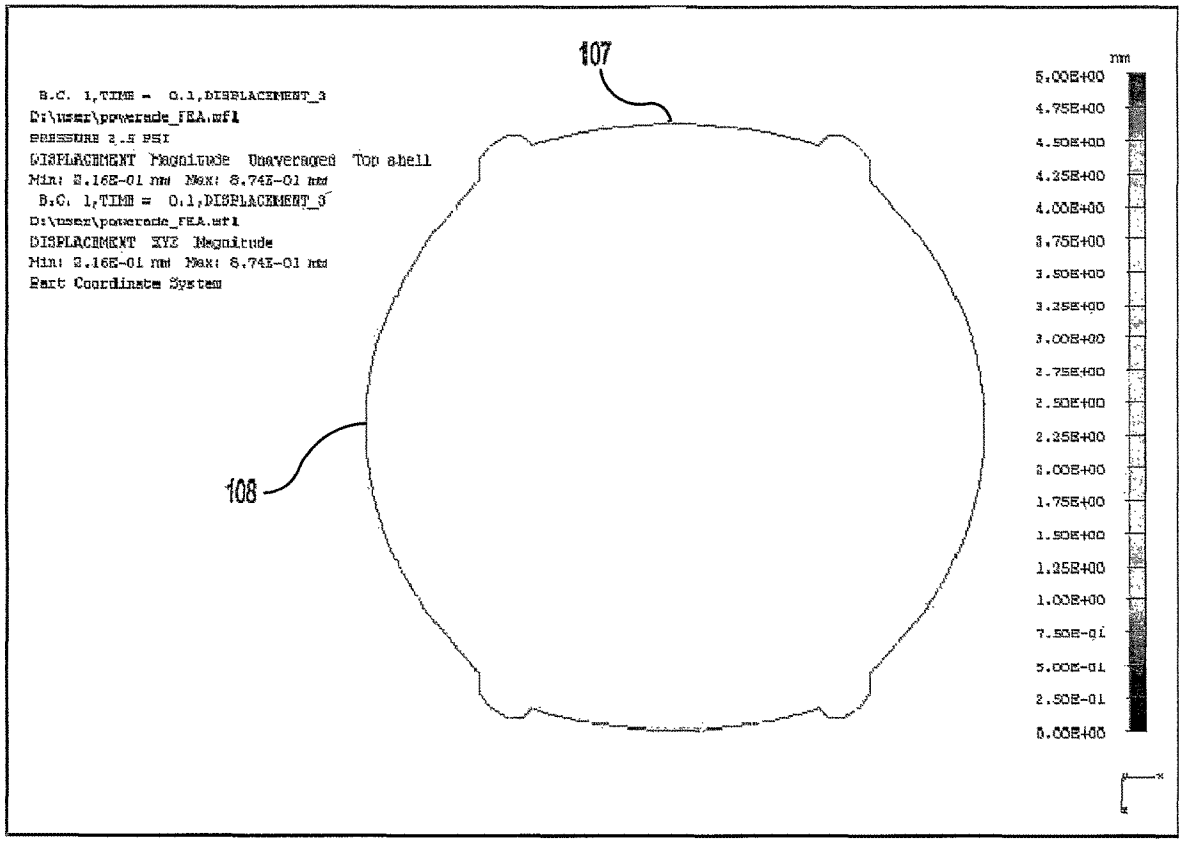
FIGS. 16A-16E show FEA cross-sectional views through line B-B of the container shown in FIG. 1A under vacuum pressure of about 0.250 PSI (FIG. 16A), to about 0.500 PSI (FIG. 16B), to about 0.750 PSI (FIG. 16C), to about 1.000 PSI (FIG. 16D), to about 1.250 PSI (FIG. 16E).

Each controlled deflection flex panel 107 is generally outwardly curved in cross-section. Further, the amount of outward curvature varies along the longitudinal length of the flex panel, such that response to vacuum pressure varies in different regions of the flex panel 107. FIG. 16A shows the outward curvature in cross-section through Line B-B of FIG. 1A. A cross-section higher through the flex panel region (i.e., closer to the bell) would reveal the outward curvature to be less than through Line B-B, and a cross-section through the flex panel relatively lower on the body 102 and closer to the junction with the base 126 of the container 101 would reveal a greater outward curvature than through Line B-B.

Each controlled deflection flex panel 108 is also generally outwardly curved in cross-section. Similarly, the amount of outward curvature varies along the longitudinal length of the flex panel 108, such that response to vacuum pressure varies in different regions of the flex panel. FIG. 16A shows the outward curvature in cross-section through Line B-B of FIG. 1A. A cross-section higher through the flex panel region (i.e., closer to the bell) would reveal the outward curvature to be less than through Line B-B, and a cross-section through the flex panel 108 relatively lower on the body 102 and closer to the junction with the base 126 of the container 101 would reveal a greater outward curvature than through Line B-B.

In this embodiment, the amount of arc curvature contained within controlled deflection flex panel 107 is different to that contained within controlled deflection flex panel 108. This provides greater control over the movement of the larger flex panels 108 than would be the case if the panels 107 were not present or replaced by strengthened regions, or land areas or posts for example. By separating a pair of flex panels 108, which are disposed opposite each other, by a pair of flex panels 107, the amount of vacuum force generated against flex panels 108 during product contraction can be manipulated. In this way undue distortion of the major panels may be avoided.

In this embodiment, the flex panels 107 provide for earlier response to vacuum pressure, thus removing pressure response necessity from flex panels 108. FIGS. 16A to 16E show gradual increases in vacuum pressure within the container. Flex panels 107 respond earlier and more aggressively than flex panels 108, despite the larger size of flex panels 108 which would normally provide most of the vacuum compensation within the container. Controlled deflection flex panels 107 invert and remain inverted as vacuum pressure increases. This results in full vacuum accommodation being achieved well before full potential is realized from the larger flex panels 108. Controlled deflection flex panels 108 may continue to be drawn inwardly should increased vacuum be experienced under aggressive conditions, such as greatly decreased temperature (e.g., deep refrigeration), or if the product is aged leading to an increased migration of oxygen and other gases through the plastic sidewalls, also causing increased vacuum force.

The improved arrangement of the foregoing and other embodiments of the present invention provides for a greater potential for response to vacuum pressure than that which has been known in the prior art. The container 101 may be squeezed to expel contents as the larger panels 108 are squeezed toward each other, or even if the smaller panels 107 are squeezed toward each other. Release of squeeze pressure results in the container immediately returning to its intended shape rather than remain buckled or distorted. This is a result of having the opposing set of panels having a different response to vacuum pressure levels. In this way, one set of panels will always set the configuration for the container as a whole and not allow any redistribution of panel set that might normally occur otherwise.

Vacuum response is spread circumferentially throughout the container, but allows for efficient contraction of the sidewalls such that each pair of panels may be drawn toward each other without undue force being applied to the posts 109 separating each panel. This overall setup leads to less container distortion at all levels of vacuum pressure than prior art, and less sideways distortion as the larger panels are brought together. Further, a higher level of vacuum compensation is obtained through the employment of smaller vacuum panels set between the larger ones, than would otherwise be obtained by the larger ones alone. Without the smaller panels undue force would be applied to the posts by the contracting larger panels, which would take a less favorable orientation at higher vacuum levels.

The above is offered by way of example only, and the size, shape, and number of the panels 107 and the size, shape, and number of the panels 108, and the size, shape, and number of reinforcement ribs 118 is related to the functional requirements of the size of the container, and could be increased or decreased from the values given.

It is to be understood, however, that even though numerous characteristics and advantages of the present invention have been set forth in the foregoing description, together with details of the structure and function of the invention, the disclosure is illustrative only, and changes may be made in detail, especially in matters of shape, size and arrangement of parts within the principles of the invention to the full extent indicated by the broad general meaning of the terms in which the appended claims are expressed.

The embodiments shown in FIGS. 1A and 1B, as well as those shown in FIGS. 1C, 1D, 1E, and 1F, relate to a container 101, 101' having four controlled deflection flex panels 107 and 108, working in tandem in primary and secondary capacity, thereby reducing the negative internal pressure effects during cooling of a product.

For example, containers 101, 101' are able to withstand the rigors of hot fill processing. In a hot fill process, a product is added to the container at an elevated temperature, about 82° C., which can be near the glass transition temperature of the plastic material, and the container is capped. As container 101, 101' and its contents cool, the contents tend to contract and this volumetric change creates a partial vacuum within the container. Other factors can cause contraction of the container content, creating an internal vacuum that can lead to distortion of the container. For example, internal negative pressure may be created when a packaged product is placed in a cooler environment (e.g., placing a bottle in a refrigerator or a freezer), or from moisture loss within the container during storage.

In the absence of some means for accommodating these internal volumetric and barometric changes, containers tend to deform and/or collapse. For example, a round container 101, 101' can undergo ovalization, or tend to distort and become out of round. Containers of other shapes can become similarly distorted. In addition to these changes that adversely affect the appearance of the container, distortion or deformation can cause the container to lean or become unstable. This is particularly true where deformation of the base region occurs. As supporting structures are removed from the side panels of a container, base distortion can become problematic in the absence of mechanism for accommodating the vacuum. Moreover, configuration of the panels provides additional advantages (e.g., improved top-load performance) allowing the container to be lighter in weight.

The novel design of container 101, 101' increases volume contraction and vacuum uptake, thereby reducing negative internal pressure and unnecessary distortion of the container 101, 101' to provide improved aesthetics, performance and end user handling.

Referring now to FIGS. 1C, 1D, 1E, and 1F, the container 101' may comprise a plastic body 102 suitable for hot-fill application, having a neck portion 103 defining an opening 104, connected to a shoulder portion 105 extending downward and connecting to a sidewall 106 extending downward and joining a bottom portion 122 forming a base 126. The sidewall 106 includes four controlled deflection flex panels 107 and 108 and includes a post or vertical transitional wall 109 disposed between and joining the primary and secondary panels 107 and 108. The body 102 of the container 101' is adapted to increase volume contraction and reduce pressure during hot-fill processing, and the panels 107 and 108 are adapted to contract inward from vacuum forces created from the cooling of a hot liquid during hot-fill application.

The container 101' can be used to package a wide variety of liquid, viscous or solid products including, for example, juices, other beverages, yogurt, sauces, pudding, lotions, soaps in liquid or gel form, and bead shaped objects such as candy.

The present container can be made by conventional blow molding processes including, for example, extrusion blow molding, stretch blow molding and injection blow molding. In extrusion blow molding, a molten tube of thermoplastic material, or plastic parison, is extruded between a pair of open blow mold halves. The blow mold halves close about the parison and cooperate to provide a cavity into which the parison is blown to form the container. As formed, the container can include extra material, or flash, at the region where the molds come together, or extra material, or a moil, intentionally present above the container finish. After the mold halves open, the container drops out and is then sent to a trimmer or cutter where any flash of moil is removed. The finished container may have a visible ridge formed where the two mold halves used to form the container came together. This ridge is often referred to as the parting line.

In stretch blow molding, a preformed parison, or preform, is prepared from a thermoplastic material, typically by an injection molding process. The preform typically includes a threaded end, which becomes the threads of the container.

The preform is positioned between two open blow mold halves. The blow mold halves close about the preform and cooperate to provide a cavity into which the preform is blown to form the container. After molding, the mold halves open to release the container. In injection blow molding, a thermoplastic material, is extruded through a rod into an inject mold to form a parison. The parison is positioned between two open blow mold halves. The blow mold halves close about the parison and cooperate to provide a cavity into which the parison is blown to form the container. After molding, the mold halves open to release the container.

In one exemplary embodiment, the container may be in the form of a bottle. The size of the bottle may be from about 8 to 64 ounces, from about 16 to 24 ounces, or either 16 or 20 ounce bottles. The weight of the container may be based on gram weight as a function of surface area (e.g., 4.5 square inches per gram to 2.1 square inches per gram).

The sidewall, as formed, is substantially tubular and can have a variety of cross sectional shapes. Cross sectional shapes include, for example, a generally circular transverse cross section, as illustrated; a substantially square transverse cross section; other substantially polygonal transverse cross sectional shapes such as triangular, pentagonal, etc.; or combinations of curved and arced shapes with linear shapes. As will be understood, when the container has a substantially polygonal transverse cross sectional shape, the corners of the polygon may be typically rounded or chamfered.

In an exemplary embodiment, the shape of container, e.g., the sidewall, the shoulder and/or the base of the container may be substantially round or substantially square shaped. For example, the sidewall can be substantially round (e.g., as in FIGS. 1A-1F) or substantially square shaped (e.g., as in FIG. 9).

The container 101' has a one-piece construction, and can be prepared from a monolayer plastic material, such as a polyamide, for example, nylon; a polyolefin such as polyethylene, for example, low density polyethylene (LDPE) or high density polyethylene (HDPE), or polypropylene; a polyester, for example polyethylene terephthalate (PET), polyethylene naphtalate (PEN); or others, which can also include additives to vary the physical or chemical properties of the material. For example, some plastic resins can be modified to improve the oxygen permeability. Alternatively, the container can be prepared from a multilayer plastic material. The layers can be any plastic material, including virgin, recycled and reground material, and can include plastics or other materials with additives to improve physical properties of the container. In addition to the above-mentioned materials, other materials often used in multilayer plastic containers include, for example, ethylvinyl alcohol (EVOH) and tie layers or binders to hold together materials that are subject to delamination when used in adjacent layers. A coating may be applied over the monolayer or multilayer material, for example to introduce oxygen barrier properties. In an exemplary embodiment, the present container may be made of a generally biaxially oriented polyester material, e.g., polyethylene terephthalate (PET), polypropylene or any other organic blow material which may be suitable to achieve the desired results.

In another embodiment, the shoulder portion, the bottom portion and/or the sidewall may be independently adapted for label application. The container may include a closure 123, 223, 323, 423, 523, 623, 723, 823, 923, 1023, 1123, 1223, 1323 (e.g., FIGS. 1C and 2A-13A) engaging the neck portion and sealing the fluid within the container.

As exemplified in FIGS. 1C-1F, the four panels 107 and 108 may comprise a pair of opposing primary panels 107 and a pair of secondary panels 108, which work in tandem in primary and secondary capacity.

Generally, the primary panels 107 may comprise a smaller surface area and/or have a geometric configuration adapted for greater vacuum uptake than the secondary panels. In an exemplary embodiment, the size of the secondary panel 108 to primary panel 107 may be slightly larger than the primary panel, e.g., at least about 1:1 (e.g., FIG. 9). In another aspect, the size of the secondary panel 108 to primary panel 107 may be in a ratio of about 3:1 or 7:5 or the secondary panel 108 may be at least 70% larger than the primary panel 107, or 2:1 or 50% larger.

Prior to relief of negative internal pressure (e.g., during hot-fill processing), the primary panels 107 and secondary panels 108 may be designed to be convex, straight or concave shaped, and/or combinations thereof, so that after cooling of a closed container or after filling the container with hot product, sealing and cooling, the primary panels and/or secondary panels would decrease in convexity, become vertically straight or increase in concavity. The convexity or concavity of the primary and/or the secondary panels 107, 108 may be in the vertical or horizontal directions (e.g., in the up and down direction or around the circumference or both). In alternative embodiments, the secondary panels 108 may be slightly convex while the primary panels 107 are flat, concave or less convex than their primary panel 108 counterparts. Alternatively, the secondary panels 108 may be substantially flat and the primary panel 107 concave.

The primary and secondary panels 107,108 cooperate to relieve internal negative pressure due to packaging or subsequent handling and storage. Of the pressure relieved, the primary panels 107 may be responsible for greater than 50% of the vacuum relief or uptake. The secondary panels 108 may be responsible for at least a portion (e.g., 15% or more) of the vacuum relief or uptake. For example, the primary panels 107 may absorb greater than 50%, 56% or 85% of a vacuum developed within developed within the container (e.g., upon cooling after hot-filling).

Generally, the primary panels 107 are substantially devoid of structural elements, such as ribs, and are thus more flexible, have less deflection resistance, and therefore have more deflection than secondary panels, although some minimal ribbing may be present as noted above to add structural support to the container overall. The panels 107 may progressively exhibit an increase in deflection resistance as the panels are deflected inward.

In an alternative embodiment, the primary panel 107, secondary panel 108, shoulder portion 105, the bottom portion 122 and/or the sidewall 106 may include an embossed motif or lettering (not shown).

As exemplified in FIGS. 1A-1E, the primary panels 107 may comprise an upper and lower portion, 110 and 111, respectively, and the secondary panels 108 may comprise an upper and lower panel walls, 112 and 113, respectively.

The primary 107 or secondary 108 panels may independently vary in width progressing from top to bottom thereof. For example, the panels may remain similar in width progressing from top to bottom thereof (i.e., they may be generally linear), may have an hourglass shape, may have an oval shape having a wider middle portion than the top and/or bottom, or the top portion of the panels may be wider than the bottom portion of the panel (i.e., narrowing) or vice-a-versa (i.e., broadening).

Figure 8C:
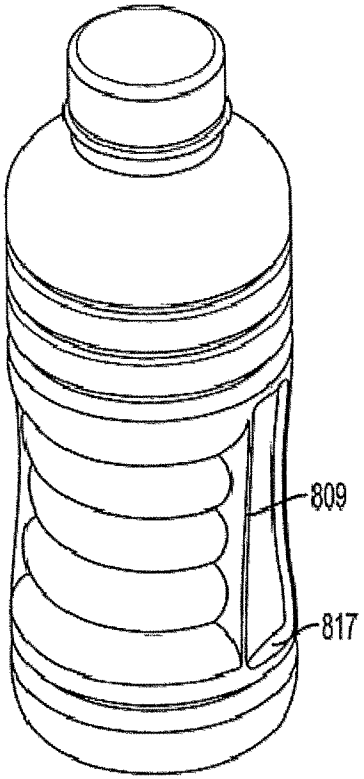
FIGS. 8A, 8B, and 8C, respectively, show side, front, and orthogonal views of a container according to an embodiment of the present invention, in which the container has concave shaped (arced) and contoured primary panels and secondary panels with contiguous, i.e., not separated by intermediate region, horizontal ribbings.
Figure 8B:
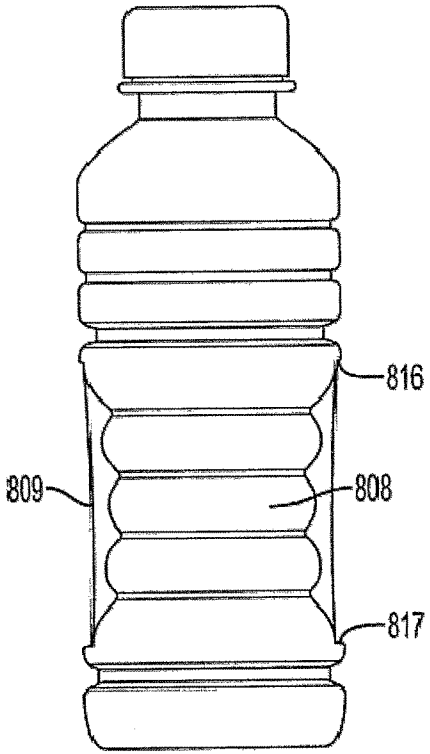
Figure 8A:
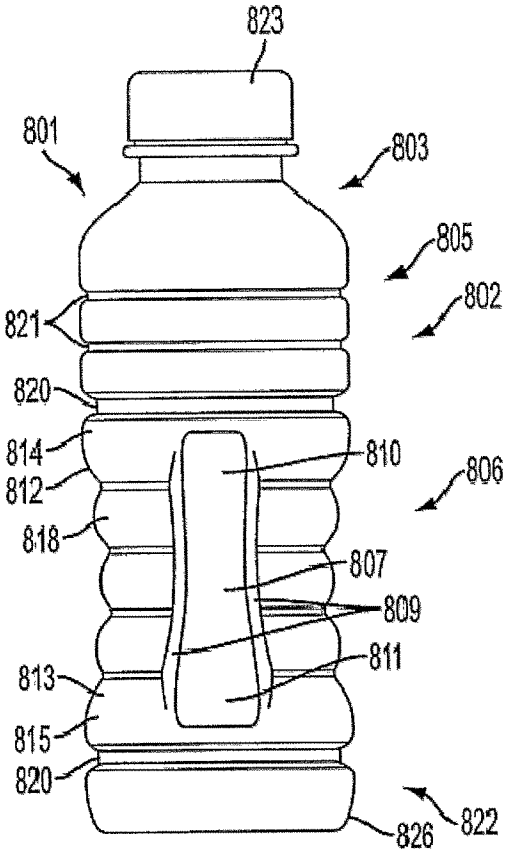

As shown in the embodiment of FIGS. 1C-1F, the primary panels 107 are vertically straight (e.g., substantially or generally flat) and have an hourglass shape progressing from top to bottom thereof. The secondary panels 108 are vertically concave (e.g., arced inwardly in progressing from top to bottom), and have a generally consistent width progressing from top to bottom thereof, although the width varies slightly with the hourglass shape of the primary panels. In other exemplary embodiments, for example those shown in FIGS. 2-7, the primary panels (e.g., 207) can be vertically concave shaped (e.g., arced moderately in progressing from top to bottom) and have an hourglass shape progressing from top to bottom thereof. In one aspect, the primary panels 107 may be vertically concave shaped (i.e., arced) and horizontally relatively flat/slightly concave (e.g., FIGS. 2C and 2D). The secondary panels in the exemplary embodiments shown in FIGS. 1-8 (e.g., 208) are vertically concave (i.e., arced) and have consistent width progressing from top to bottom thereof. In another embodiment, the primary and/or the secondary panels may have a vertically convex shape with a wider middle section than the top and bottom of the primary panel (not shown). In still other exemplary embodiments, for example as illustrated in FIGS. 8A-8C, the primary panels 807 can be vertically concave shaped (i.e., arced) and become wider progressing from top to bottom thereof. The secondary panels 808 can be vertically concave shaped (i.e., arced) and have consistent width progressing from top to bottom thereof.

Figure 9D:
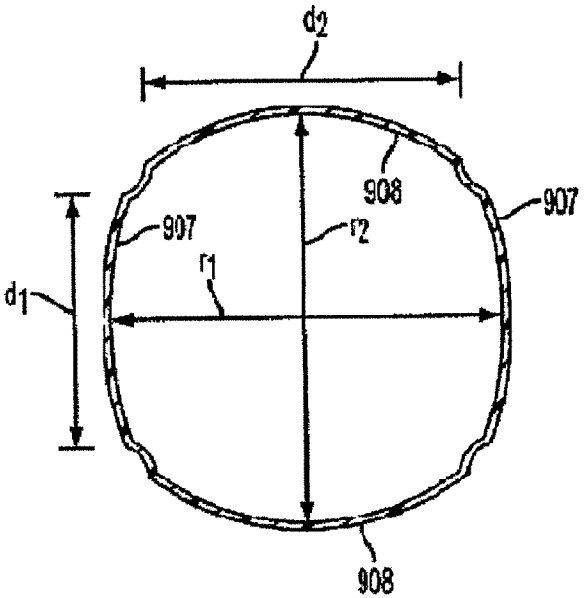
FIGS. 9A, 9B, 9C, and 9D, respectively, show side, front, orthogonal, and cross-sectional views of a container according to an embodiment of the present invention, in which the container has primary panels and secondary panels similar in size with no ribbings but different geometries.
Figure 2D:
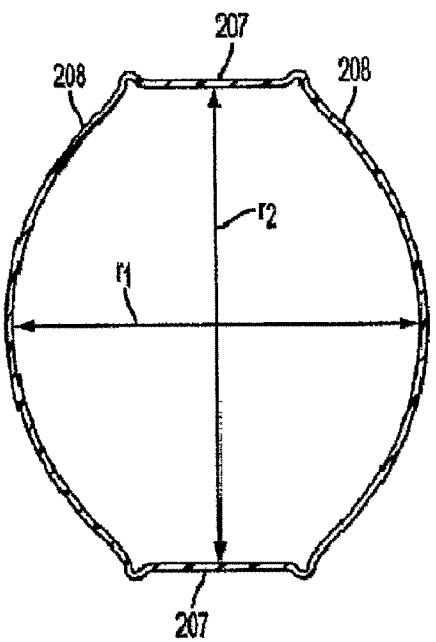
FIGS. 2A, 2B, 2C, and 2D, respectively, show side, front, orthogonal, and cross-sectional views of a container according to a third embodiment of the present invention, in which the container has vertically concave shaped (i.e., arced) primary panels that are horizontally relatively flat/slightly concave and secondary panels with horizontal ribbings separated by intermediate regions.
Figure 1F:
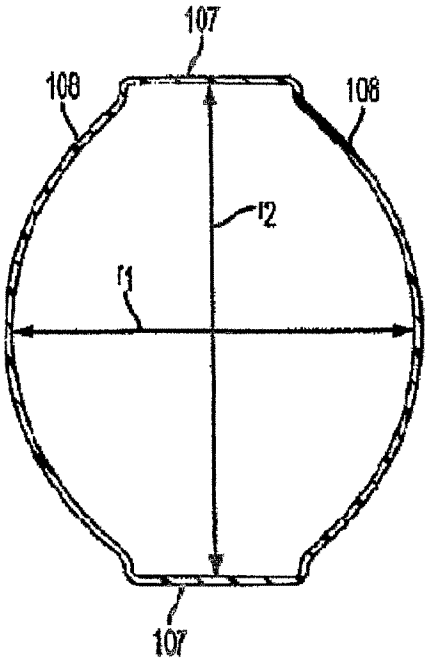
Figure 2C:
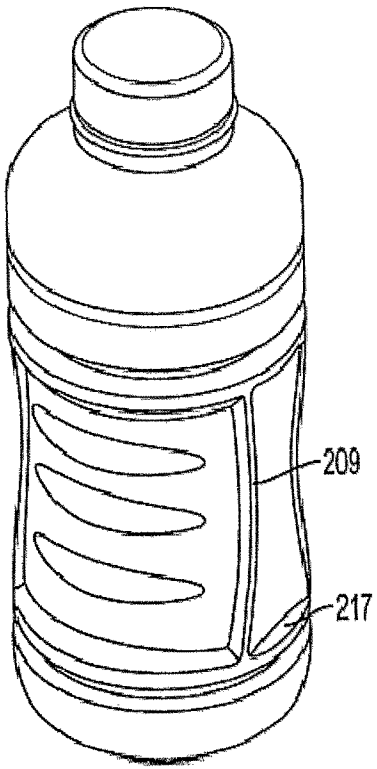
Figure 2B:
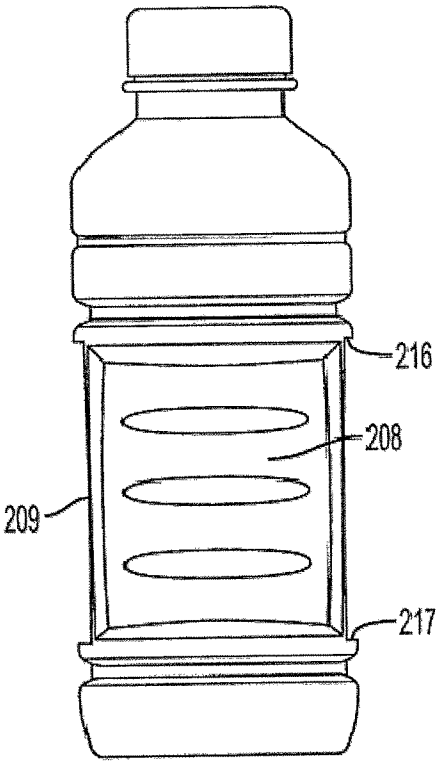
Figure 2A:
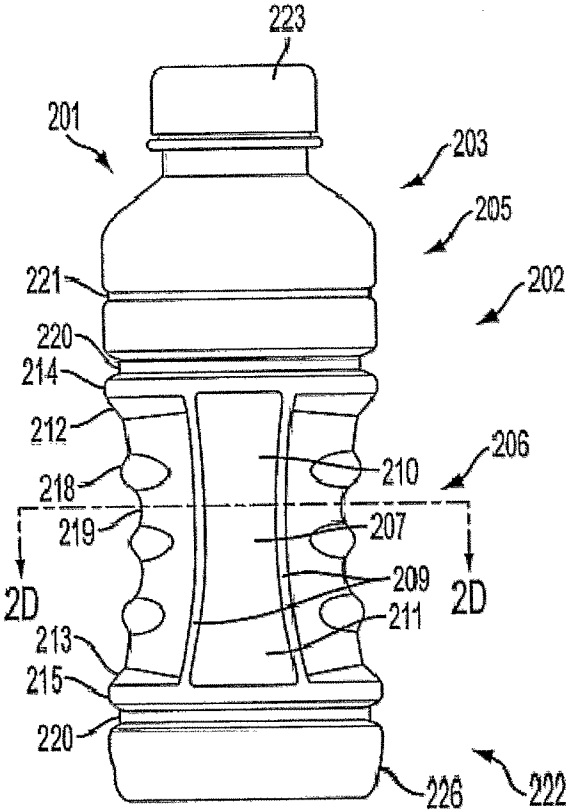
Figure 9C:
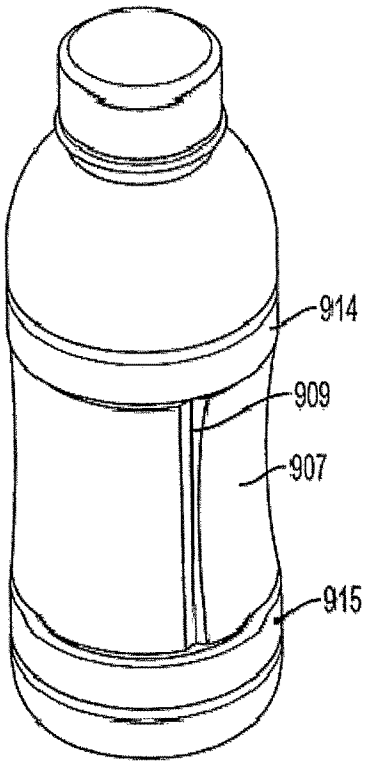
Figure 9B:
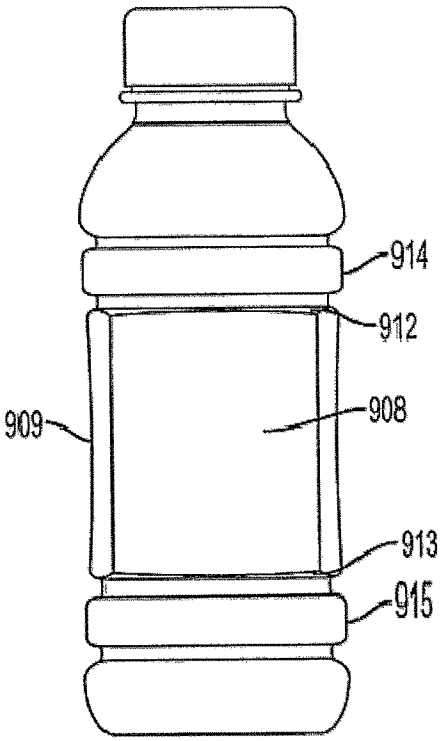
Figure 9A:
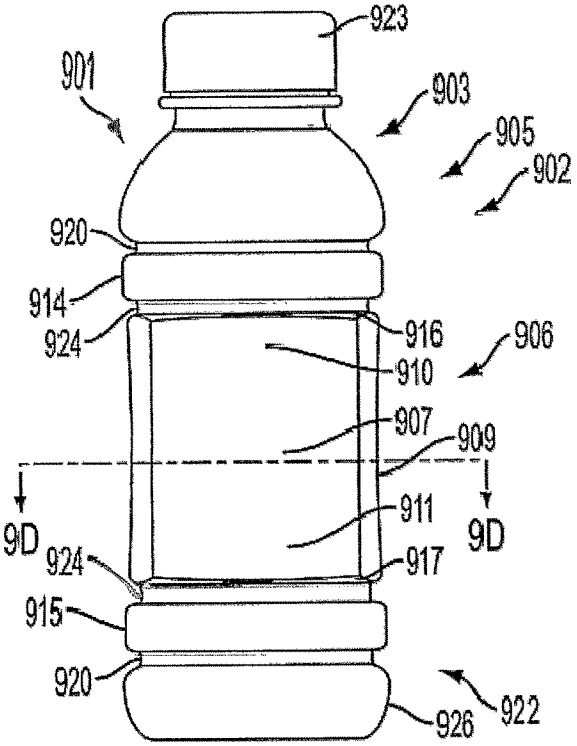

In an alternative embodiment, all four panels are similar in size (e.g., $d_1$ is approximately the same as $d_2$), as exemplified in FIG. 9D, which is a cross-section of Line 9D-9D of FIG. 9A. The primary panels 907 are vertically concave (e.g., arced inwardly in progressing from top to bottom), and have a generally consistent width progressing from top to bottom thereof, and the secondary panel 908 are vertically straight (e.g., substantially or generally flat), and have a generally consistent width progressing from top to bottom thereof. In such an embodiment, the primary panels are configured in a way to be more responsive to internal vacuum than the secondary panels. For example, the primary panels 907 are horizontally flatter (i.e., less arcuate) than are the secondary panels 908. That is, the radius of curvature ($r_1$) of the primary panels is greater than the radius of curvature ($r_2$) of the secondary panels (see, e.g., FIG. 9D). These differences in curvature result in the primary panels having an increased ability for flexure, thus allowing the primary panels to account for the majority (e.g., greater than 50%) of the total vacuum relief accomplished in the container.

Figure 10C:
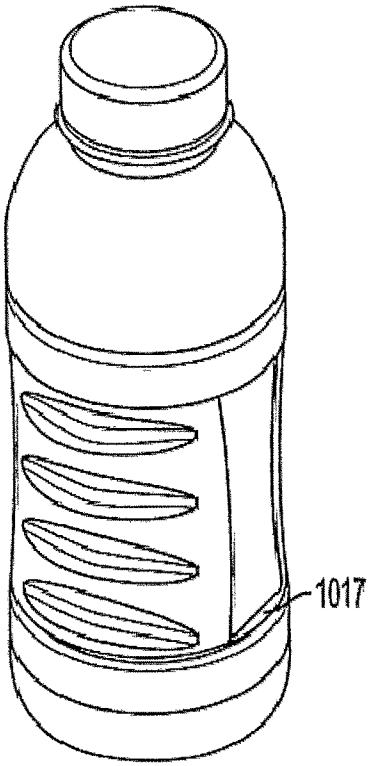
FIGS. 10A, 10B, and 10C, respectively, show side, front, and orthogonal views of a container according to an embodiment of the present invention, in which the container has vertically straight (substantially flat) primary panels and secondary panels having inwardly directed ribbings separated by intermediate regions.
Figure 10B:
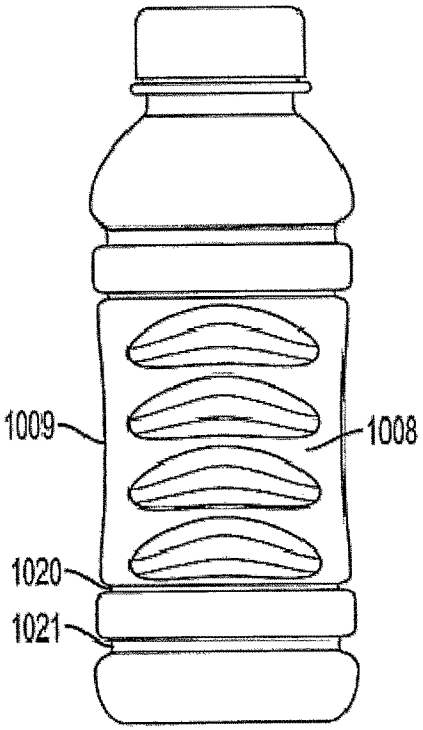
Figure 10A:
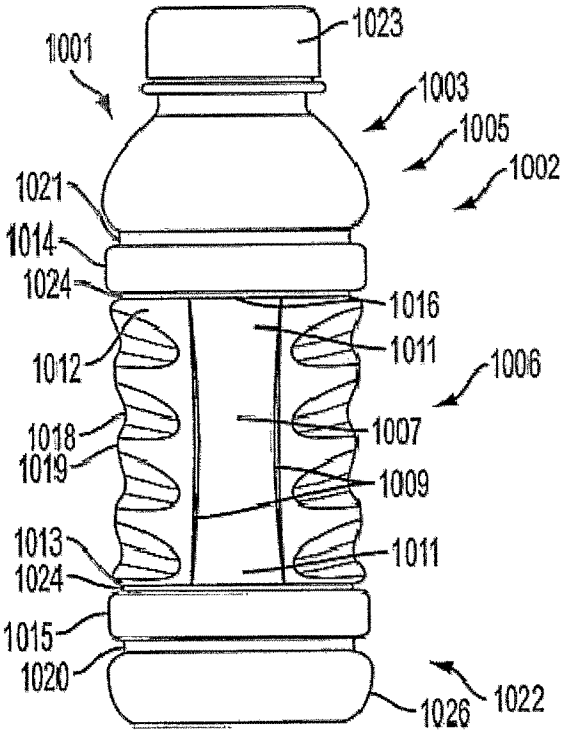

In other embodiments, as exemplified in FIGS. 10A-10C, the primary panels (e.g., 1007) can be vertically straight shaped (i.e., substantially flat) and have a consistent width progressing from top to bottom. The secondary panels (e.g., 1008) can be vertically straight shaped (i.e., substantially flat) and have consistent width progressing from top to bottom thereof.

The present invention may include a variety of these combinations and features. For example, as shown in FIGS. 12A-12C and 13A-13C, the primary panels 1207 are vertically straight (e.g., substantially or generally flat) and have a contoured shaped that becomes wider progressing from top to bottom thereof. In other exemplary embodiments (not shown), the secondary panels become progressively wider from top to bottom thereof, so that the upper panel wall is larger than the lower panel wall, and as a result, the upper portion of the secondary panel is more recessed than the lower portion.

The container 101 may also include an upper bumper wall 114 between the shoulder 105 and the sidewall 106 and a lower bumper wall 115 between the sidewall 106 and the bottom portion 122. The upper and/or lower bumper walls may define a maximum diameter of the container, or alternatively may define a second diameter, which may be substantially equal to the maximum diameter.

In the embodiments exemplified in FIGS. 1, 2 and 4-13, the upper bumper wall (e.g., 114), and lower bumper wall (e.g., 115) may extend continuously along the circumference of the container. As exemplified in FIGS. 1, 6 and 8-13, the container may also include horizontal transitional walls 116 and 117 defining the upper portion 110 and lower portion 111 of the primary panel 107 and connecting the primary panel to the bumper wall.

As in FIGS. 9-11, the horizontal transitional walls (e.g., 916 and 917) may extend continuously along the circumference of the container 901. Alternatively, as exemplified in FIGS. 4, 5, and 7, the horizontal transition walls may be absent such that the upper portion (e.g., 410) and lower portion (e.g., 411) of the primary panel (e.g., 407, transition or blend into the upper bumper wall (e.g., 414) and lower bumper wall (e.g., 415), respectively.

Figure 3C:
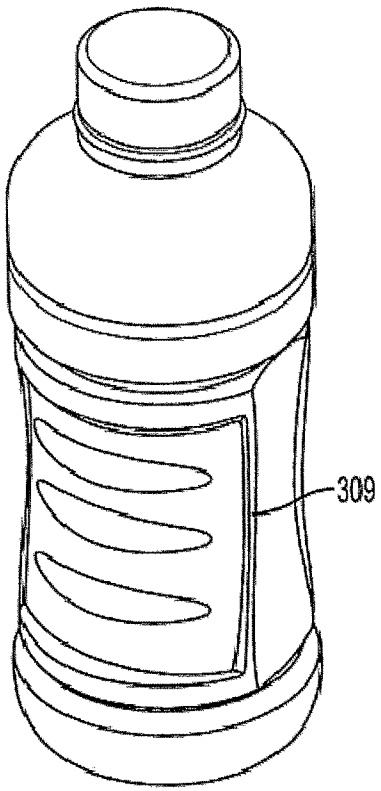
FIGS. 3A, 3B, and 3C, respectively, show side, front, and orthogonal views of a container according to a fourth embodiment of the present invention, in which the container has concave shaped (i.e., arced) primary panels extending through the upper (i.e., top) and lower (i.e., bottom) bumper walls (i.e., waists) and secondary panels with horizontal ribbings separated by intermediate regions.
Figure 3B:
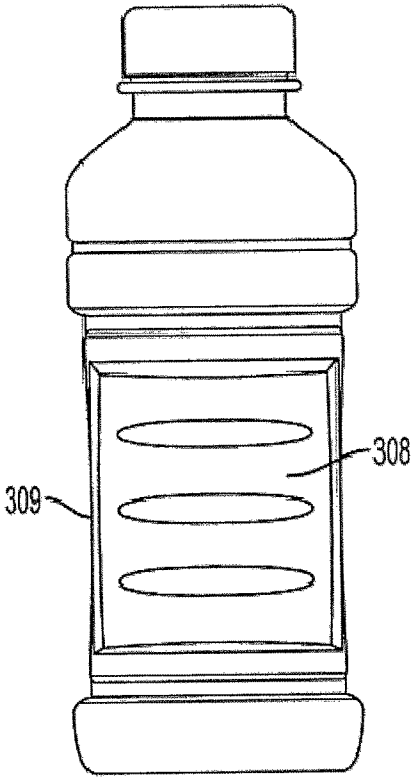
Figure 3A:
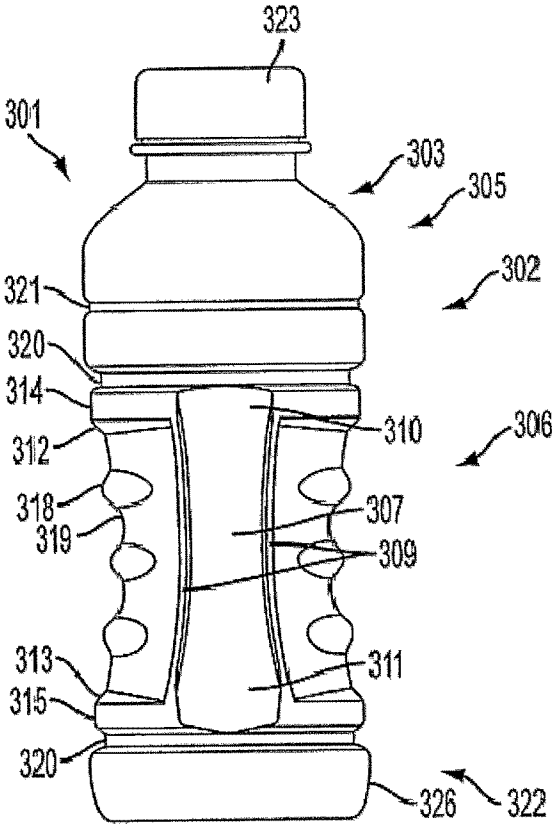
Figure 4C:
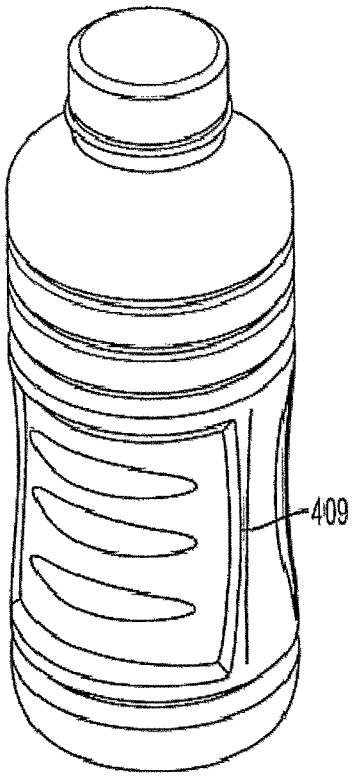
FIGS. 4A, 4B, and C, respectively, show side, front, and orthogonal views of a container according to a fifth embodiment of the present invention, in which the container has concave shaped (i.e., arced) primary panels blended into the upper (i.e., top) and lower (i.e., bottom) bumper walls (i.e., major diameters) and secondary panels with horizontal ribbings separated by intermediate regions.
Figure 4B:
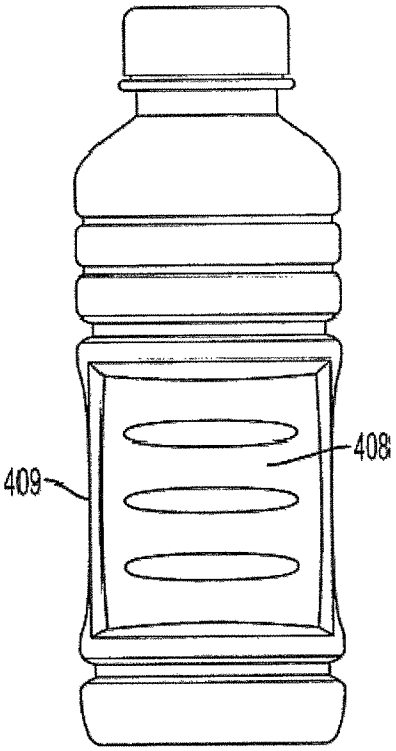
Figure 4A:
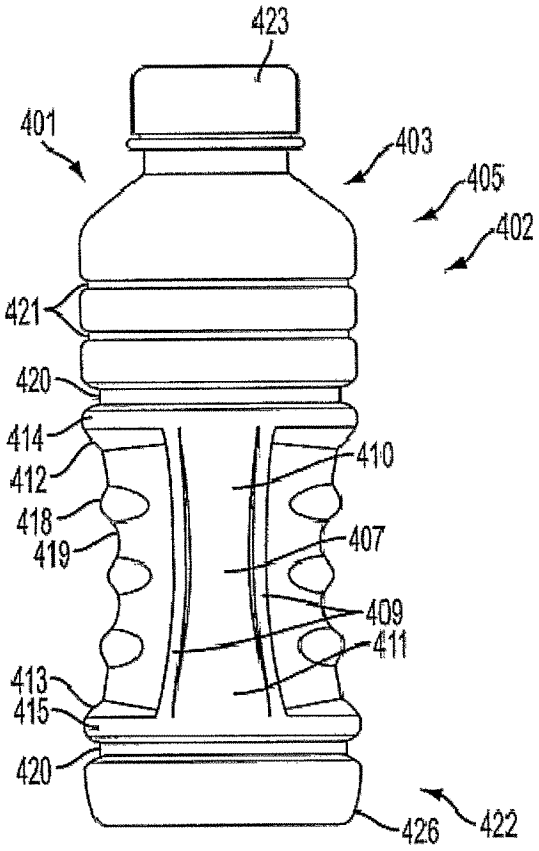
Figure 5C:
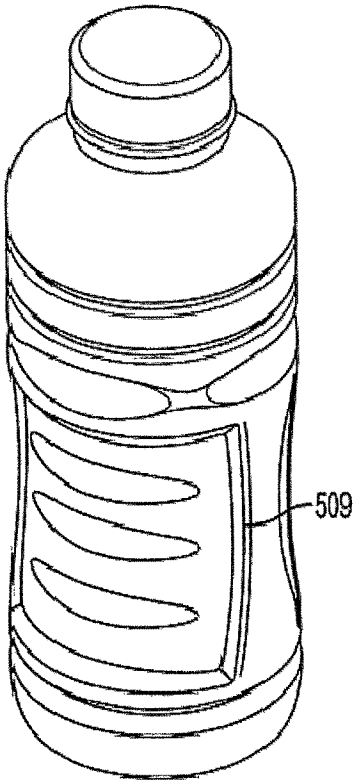
FIGS. 5A, 5B, and 5C, respectively, show side, front, and orthogonal views of a container according to a sixth embodiment of the present invention, in which the container has concave shaped (i.e., arced) primary panels blended into upper (i.e., top) and lower (i.e., bottom) bumper walls, indented recessed rib or groove and secondary panels with horizontal ribbings separated by intermediate regions.
Figure 5B:
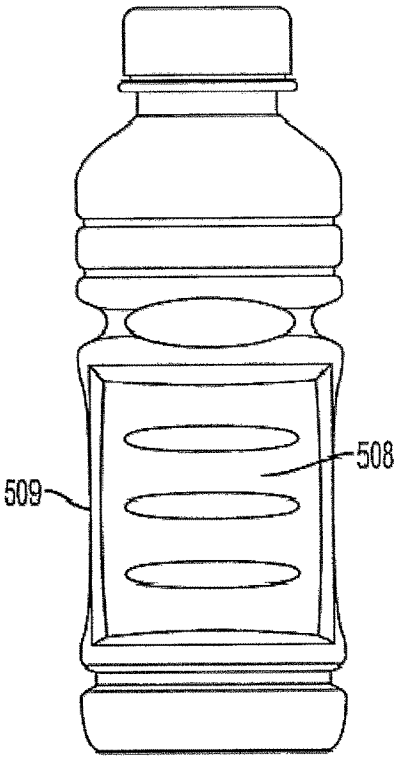
Figure 5A:
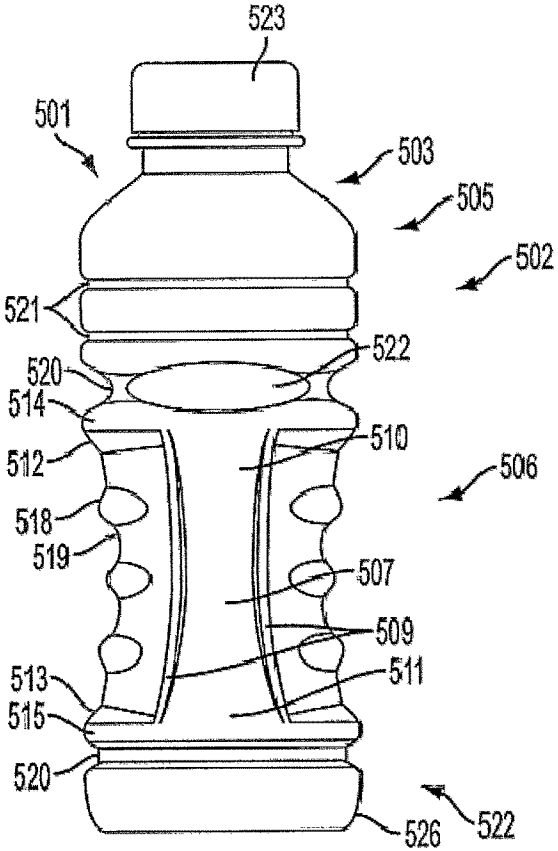
Figure 6C:
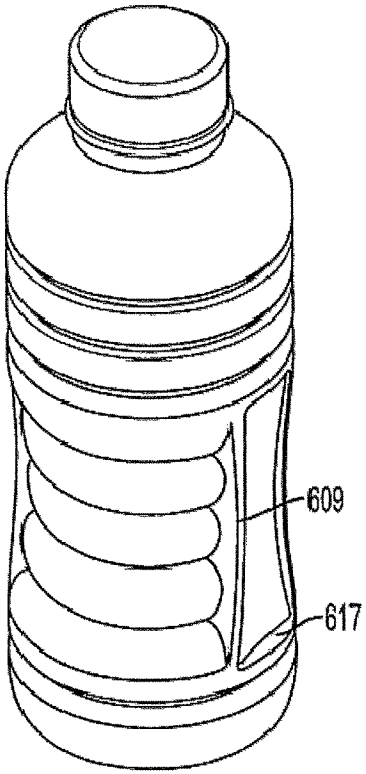
FIGS. 6A, 6B, and 6C, respectively, show side, front, and orthogonal views of a container according to a seventh embodiment of the present invention, in which the container has concave shaped (i.e., arced) primary panels and secondary panels with contiguous (i.e., not separated by intermediate region) horizontal ribbings.
Figure 6B:
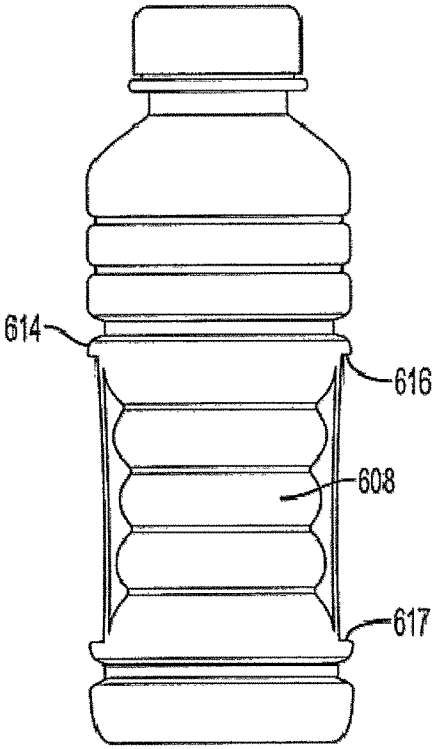
Figure 6A:
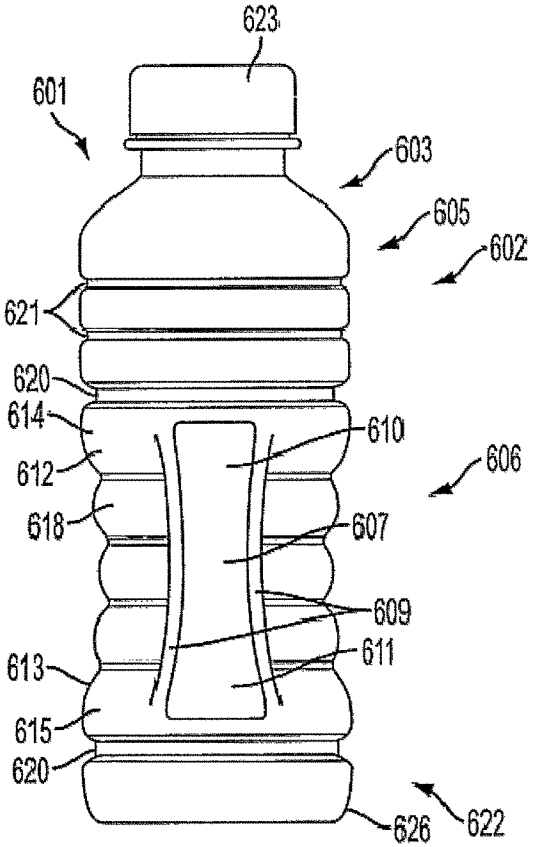
Figure 7C:
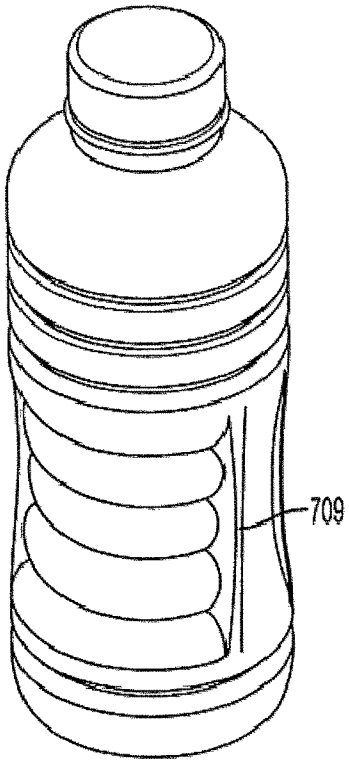
FIGS. 7A, 7B, and 7C, respectively, show side, front, and orthogonal views of a container according to and embodiment of the present invention, in which the container has concave shaped (arced) primary panels blended into the upper (top) and lower (bottom) horizontal transitional walls (major diameters) and secondary panels with contiguous, i.e., not separated by intermediate region, horizontal ribbings.
Figure 7B:
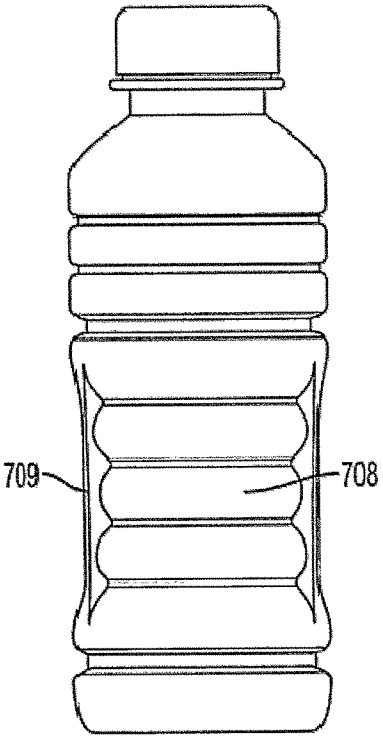
Figure 7A:
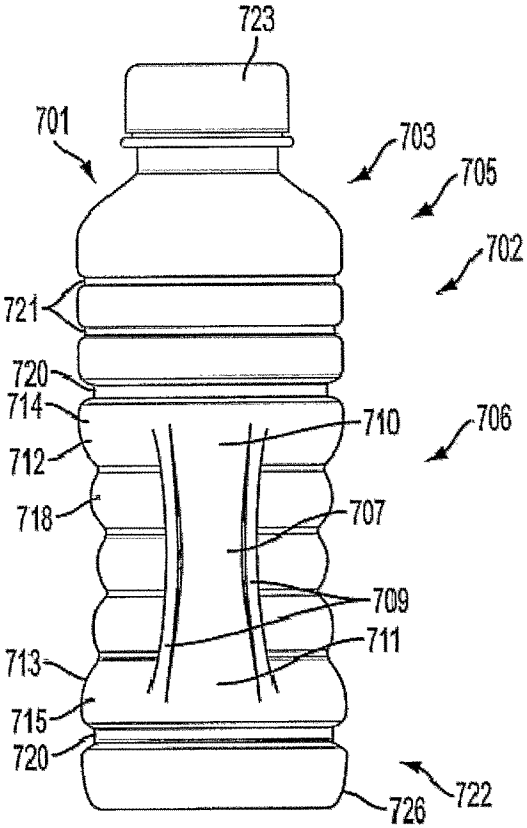

In exemplary embodiments having a primary panel that transition into the bumper wall (e.g., as in the embodiment of FIG. 3), the primary panel 307 can lack a horizontal transition wall at the top 310 and/or the bottom 311 of the primary panel 307. As shown in FIG. 3, the upper 310 and lower 311 portion of the primary panel 307 extend through the upper bumper wall 314 and lower bumper wall 315, respectively, so that the upper 314 and lower 315 bumper walls are discontinuous.

In some exemplary embodiments (e.g., FIGS. 1-8 and 10-13), the secondary panels may be contoured to include grip regions, which have anti-slip features projecting inward or outward, while providing secondary means of vacuum uptake, while the primary panels provide the primary means of vacuum uptake. The resultant exemplary design thereby reduces the internal pressure and increasing the amount of vacuum uptake and reduces label distortion, while still providing grippable regions to facilitate end user/consumer handling.

The secondary panels 108 may include at least one horizontal ribbing 118 (e.g., FIGS. 1-8 and 10-11). As exemplified in FIGS. 1-5 and 12, the secondary panels 108 can include, for example, three outwardly projecting horizontal ribbings separated by an intermediate region 119. As exemplified in FIGS. 6-8 and 13, the horizontal ribbings (e.g., 618) can be contiguous (i.e., not separated by intermediate region).

Figure 11C:
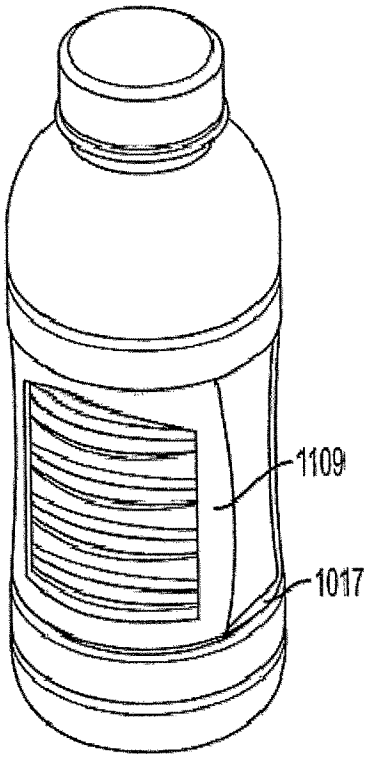
FIGS. 11A, 11B, and 11C, respectively, show side, front, and orthogonal views of a container according to an embodiment of the present invention, in which the container has vertically straight (substantially flat) primary panels and secondary panels having inwardly horizontal ribbings separated by intermediate regions.
Figure 11B:
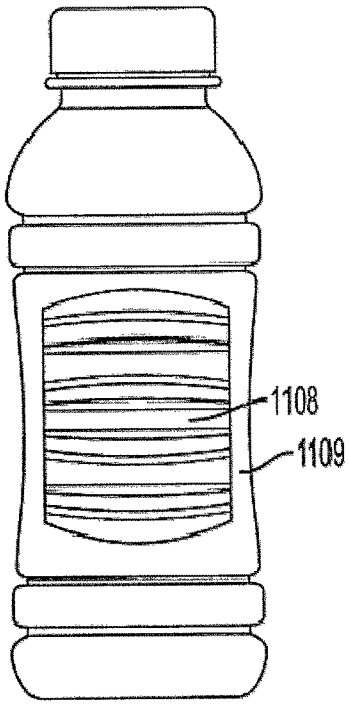
Figure 11A:
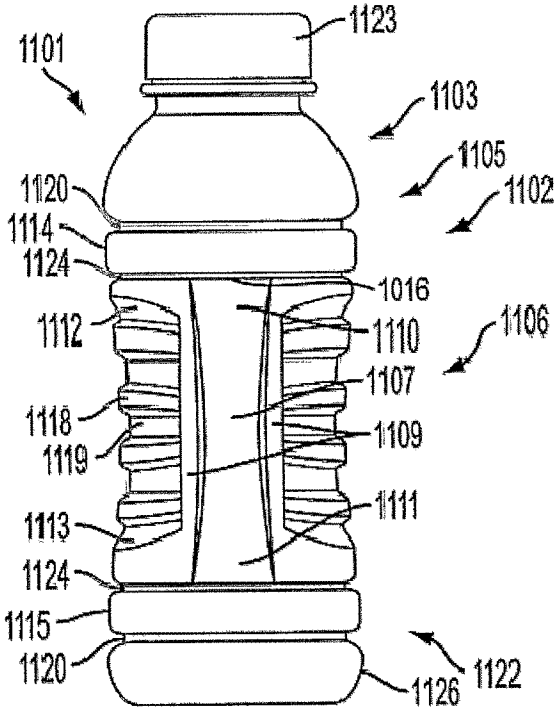
Figure 12C:
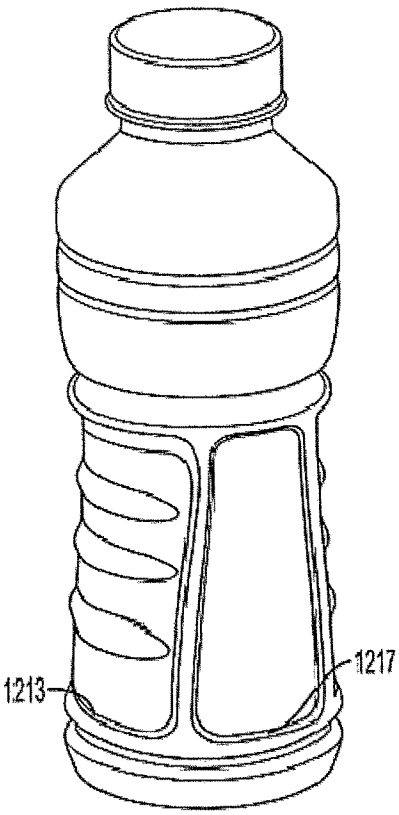
FIGS. 12A, 12B, and 12C, respectively, show side, front, and orthogonal views of a container according to an embodiment of the present invention, in which the container has an alternatively contoured vertically straight (substantially flat) primary panels and secondary panels with horizontal ribbings separated by intermediate regions.
Figure 12B:
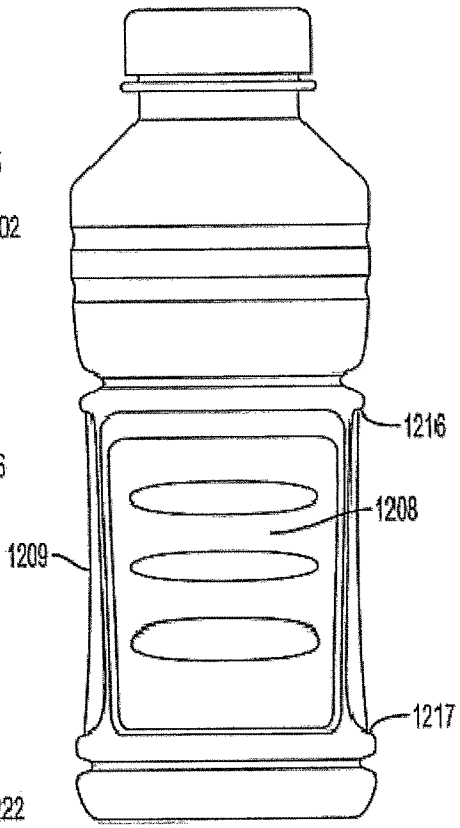
Figure 12A:
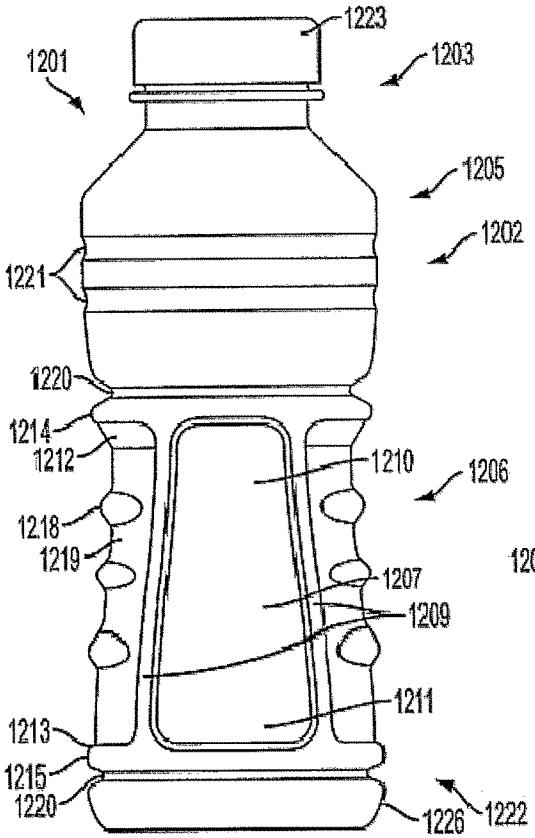
Figure 13C:
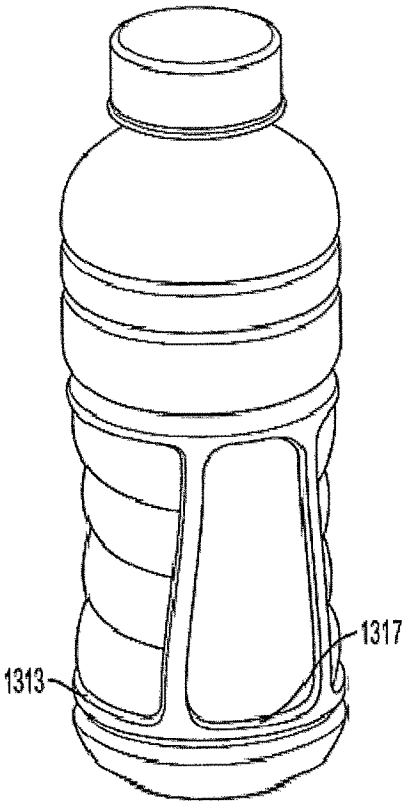
FIGS. 13A, 13B, and 13C, respectively, show side, front, and orthogonal views of a container according to an embodiment of the present invention, in which the container has an alternatively contoured vertically straight (substantially flat) primary panels and secondary panels with contiguous, i.e., not separated by intermediate region, horizontal ribbings.
Figure 13B:
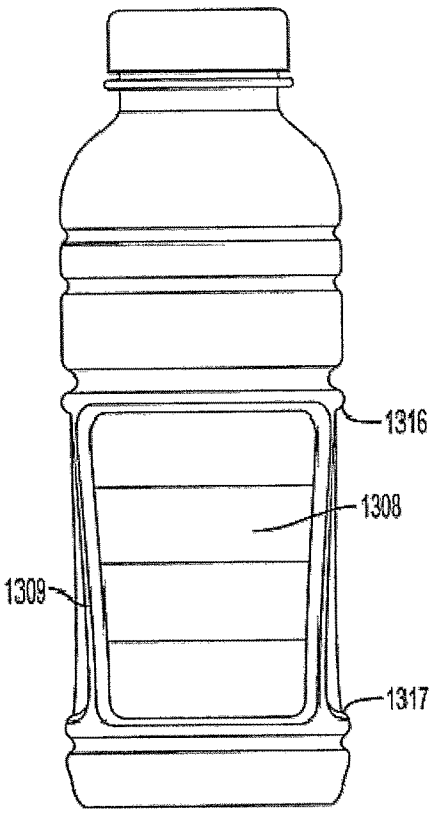
Figure 13A:
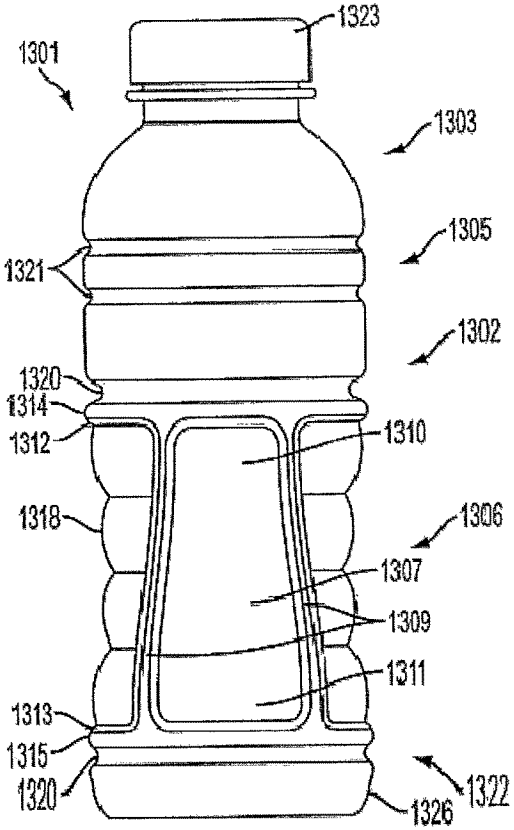

FIGS. 10A-10C illustrate an embodiment having inwardly directed recessed ribbings 1018 separated by intermediate regions 1019 and FIGS. 11A-11C show inwardly recessed ribbings 1118 having a more horizontal transition from the intermediate regions 1119.

Figure 1E:
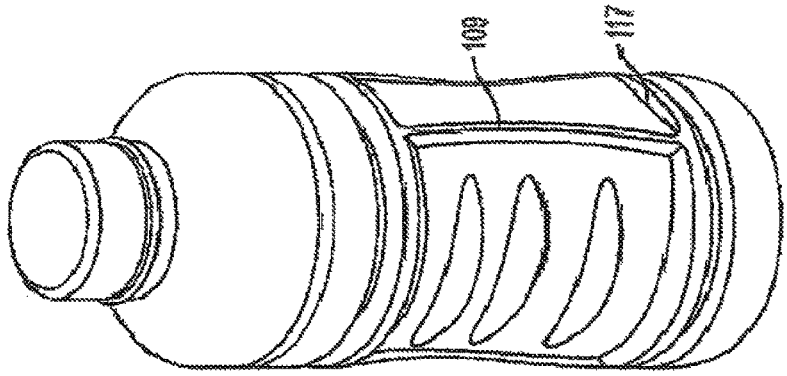
FIGS. 1C, 1D, 1E, and 1F, respectively, show side, front, orthogonal, and cross-sectional views of a container according to a second embodiment of the present invention, in which the container has vertically straight (i.e., substantially flat) primary panels and secondary panels with horizontal ribbings separated by intermediate regions.
Figure 1D:
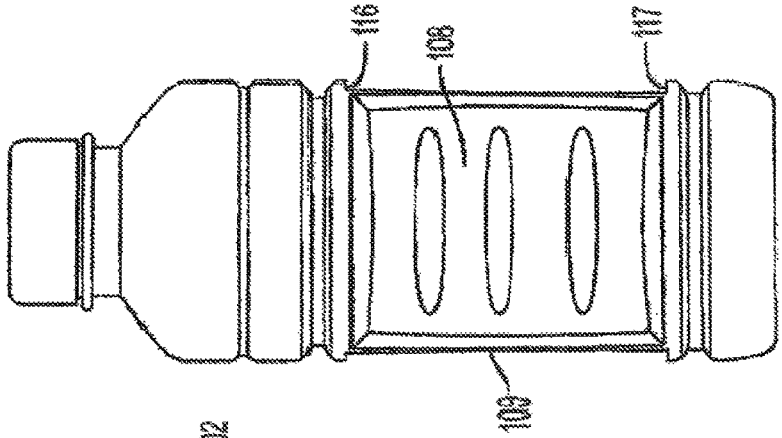
Figure 1C:
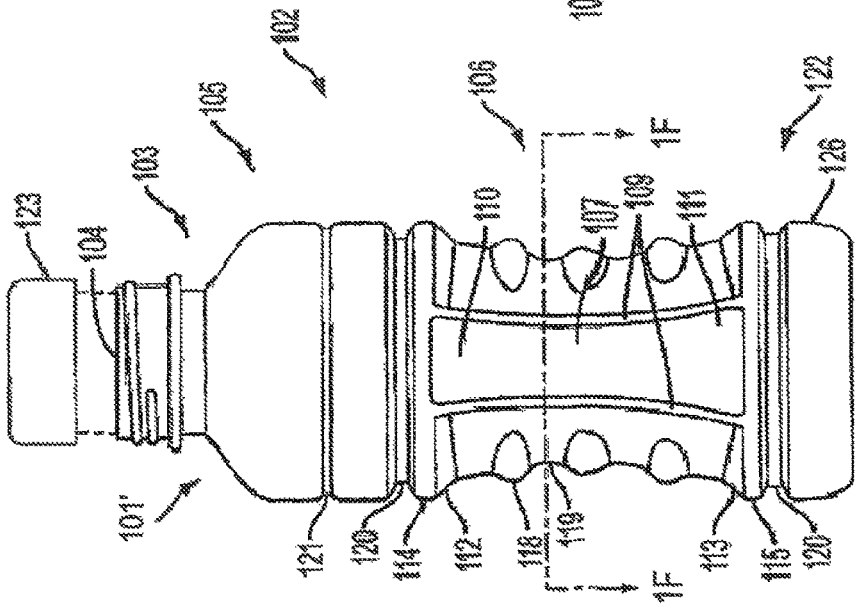

As can be seen in FIGS. 1C-1E, the container 101' may include at least one recessed rib or groove 120 between the upper bumper wall 114 and the shoulder portion 105 and/or between the lower bumper wall 115 and the base 126. Alternatively, as exemplified in FIGS. 9, 10 and 11, the container (e.g., 1001) may include at least one recessed rib or groove 1024 between the upper 1014 and/or lower 1015 bumper wall and the primary 1007 and secondary 1008 panels. The recessed rib or groove 120 may be continuous along the circumference of the container 101 (FIGS. 1-4 and 6-11). In another embodiment, the container 101 may contain at least a second recessed rib or groove 121 above the recessed rib or groove 120 above said upper bumper wall (FIGS. 1-3) or two second recessed ribs or grooves 421 (FIGS. 4-11). The second recessed rib or groove (e.g., 121 or 421) may be of lesser or greater height than the recessed rib or groove 120. In yet another embodiment, the recessed rib or groove 520 above the upper bumper wall 514 can comprise an indented portion 522 (FIGS. 5A-5C), such that the rib or groove is discontinuous.

In a further embodiment, the container may be a squeezable container, which delivers or dispenses a product per squeeze. In this embodiment, the container, once opened, may be easily held or gripped and with little resistance, the container may be squeezed along the primary or secondary panels to dispense product there from. Once squeezing pressure is reduced, the container retains its original shape without undue distortion.

Figure 14A:
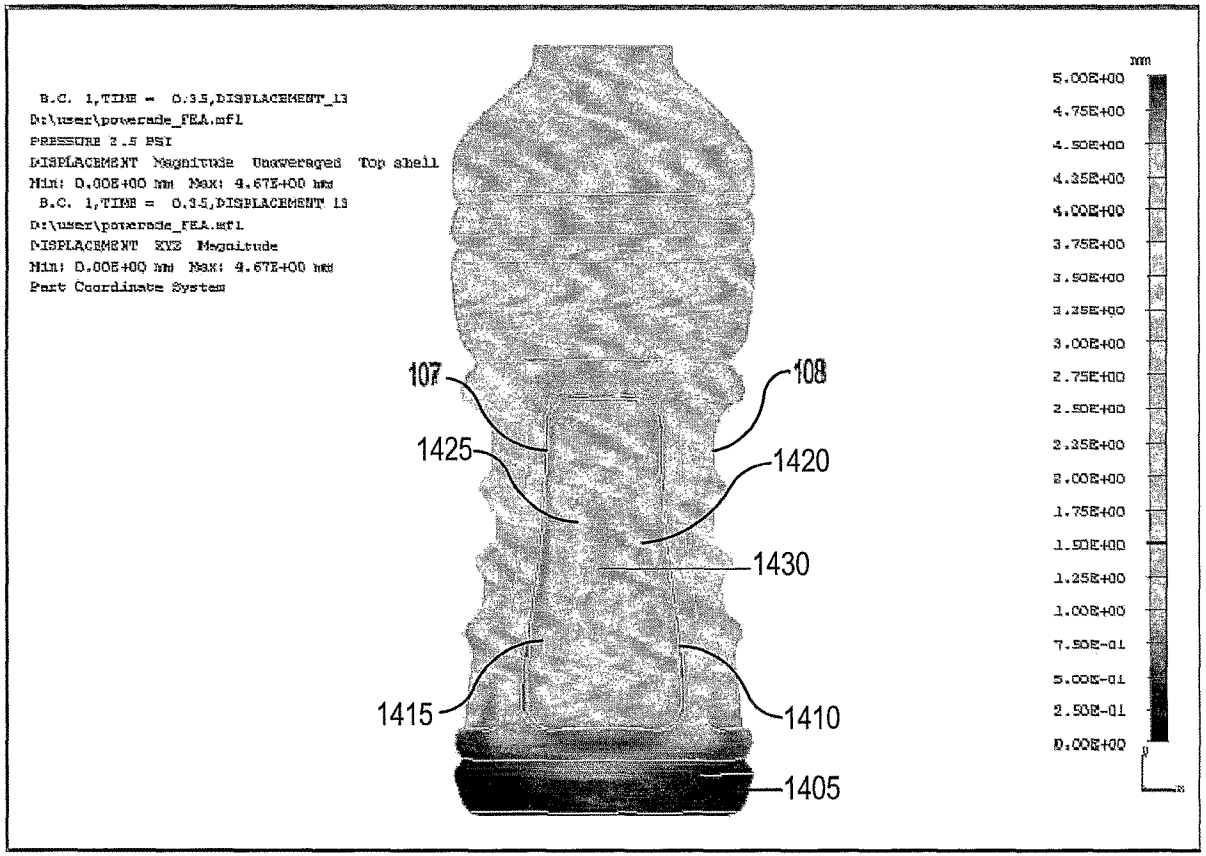
FIG. 14A shows a Finite Element Analysis (FEA) view of the container shown in FIG. 1A under vacuum pressure of about 0.875 PSI.

Referring again to FIGS. 14A and 14B, it can be seen from finite element analysis (FEA) that the primary panel 107 and second panel 108 reacts to vacuum changes with a differential amount of response. FIG. 14A depicts the container with about 0.875 pounds per square inch (PSI) of vacuum. In the vicinity of the center point of region 1430, the primary panel 107 is displaced inwardly towards the longitudinal axis of the container about 4.67 mm. Lesser amounts of such inward deflection of the primary panel 107 can be seen in the vicinity of region 1405, where there is virtually no inward deflection caused by the vacuum. Region 1410 exhibits an inward deflection of about 0.50 mm; region 1415 exhibits an inward deflection of about 1.00 mm; region 1420 exhibits an inward deflection of about 2.00 mm; and region 1425 exhibits an inward deflection of about 3.75 mm.

Figure 14B:
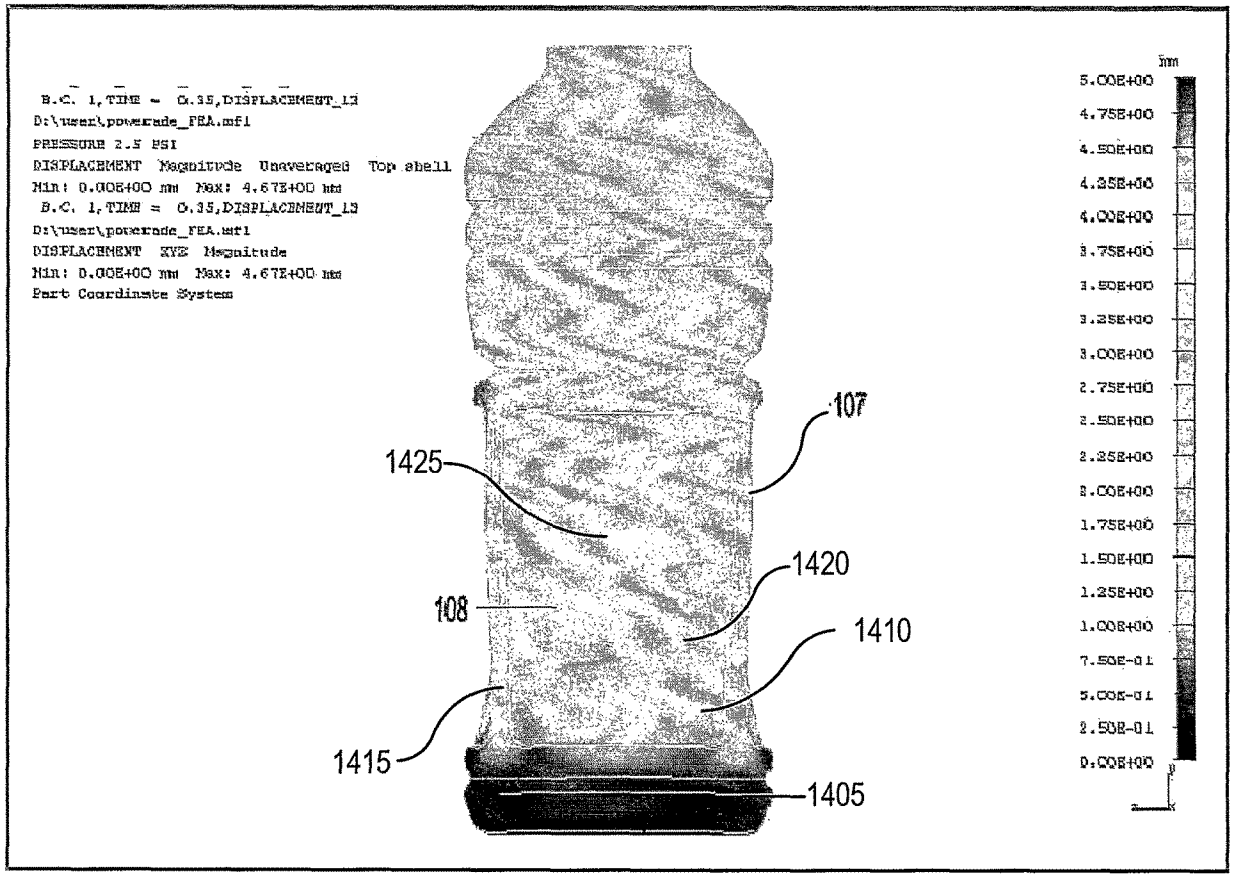
FIG. 14B shows an FEA view of the container shown in FIG. 1B under vacuum pressure of about 0.875 PSI.

Meanwhile, the secondary panel 108 exhibits relatively less inward deflection in the range of about 2.00 mm to about 3.00 mm. FIG. 14B illustrates in greater detail the impact of vacuum upon such secondary panel 108. In the vicinity of the center point of region 1425, the secondary panel 108 is displaced inwardly towards the longitudinal axis of the container about 3.75 mm. Lesser amounts of such inward deflection of the secondary panel 108 can be seen in the vicinity of region 1405, where there is virtually no inward deflection caused by the vacuum. Region 1410 exhibits an inward deflection of about 0.50 mm; region 1415 exhibits an inward deflection of about 1.00 mm; and region 1420 exhibits an inward deflection of about 2.00 mm.

Figure 15A:
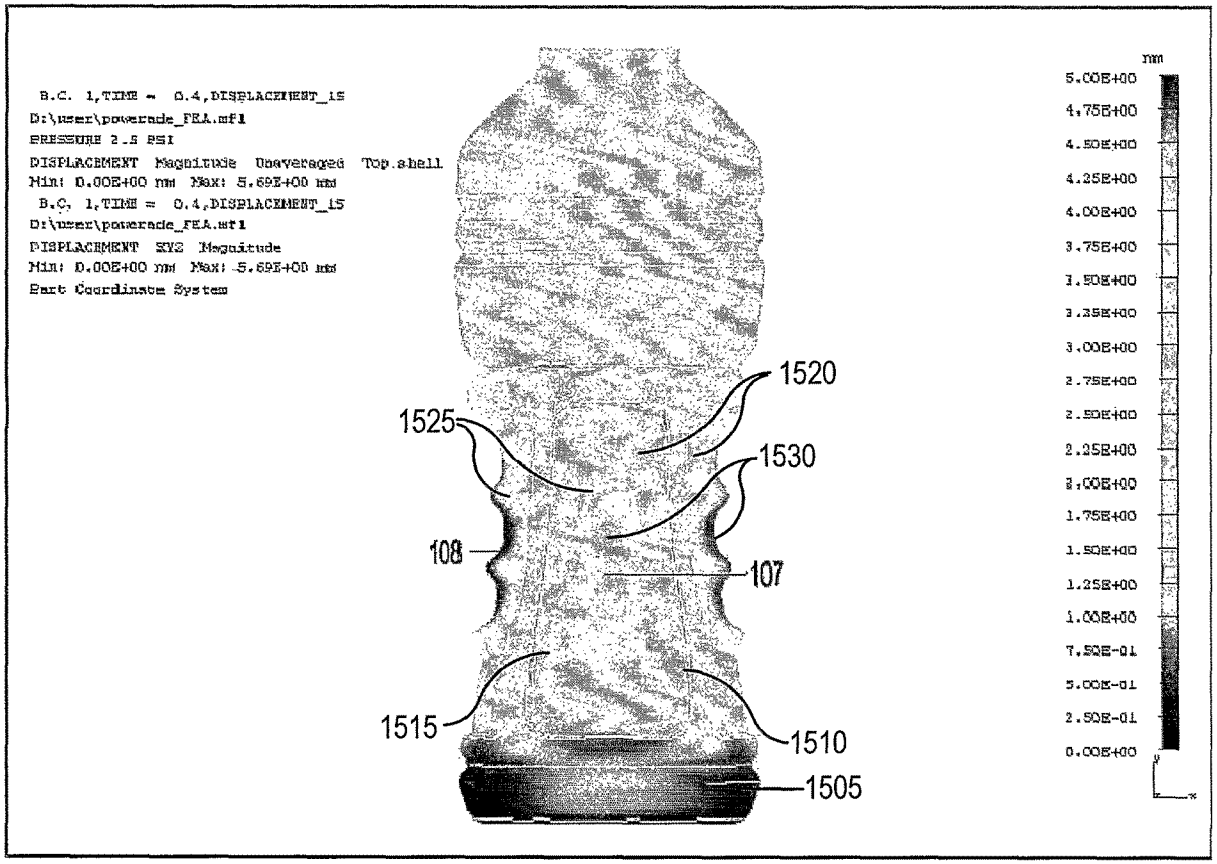
FIG. 15A shows an FEA view of the container shown in FIG. 1A under vacuum pressure of about 1.000 PSI.
Figure 15B:
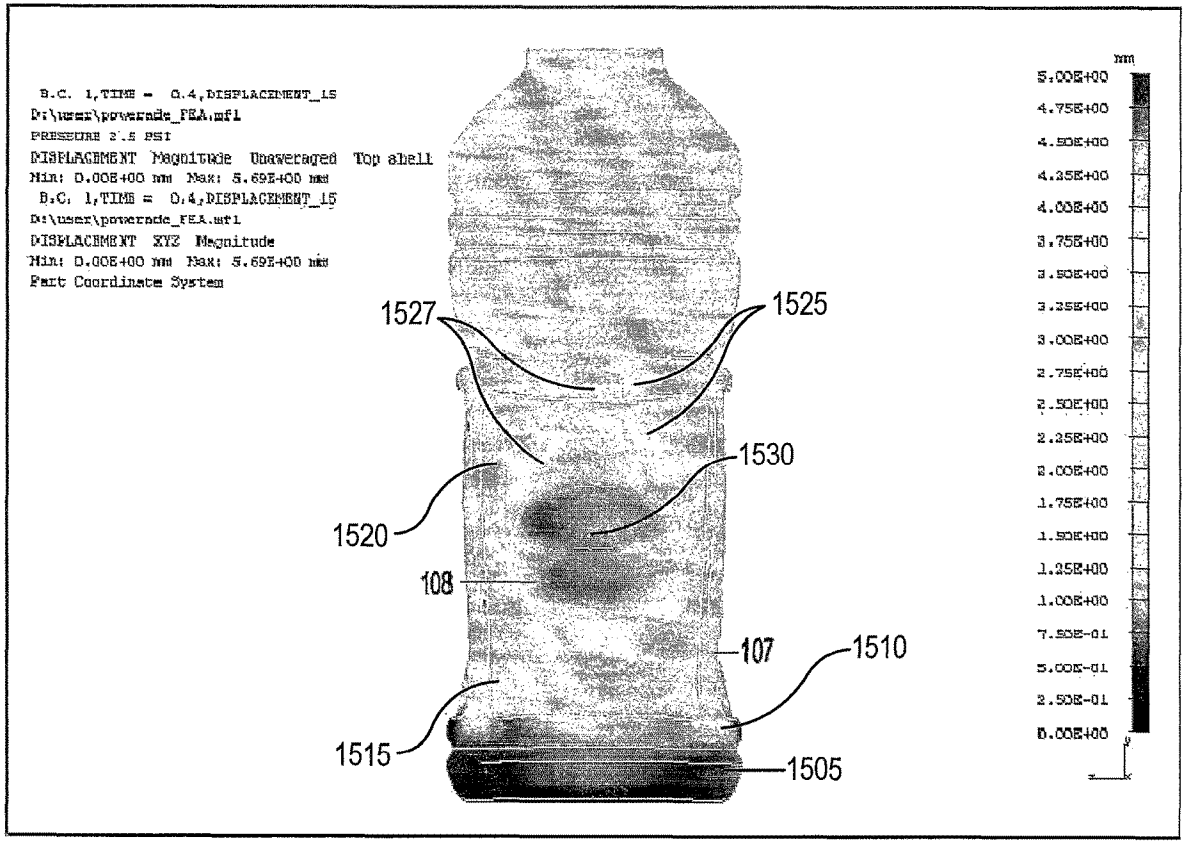
FIG. 15B shows an FEA view of the container shown in FIG. 1B under vacuum pressure of about 1.000 PSI.

Referring now to FIGS. 15A and 15B, it can be seen from the FEA that the primary panel 107 and second panel 108 continue to react to vacuum changes with a differential amount of response. FIG. 15A depicts the container with about 1.000 pounds per square inch (PSI) of vacuum. In the vicinity of the center point of region 1530, the primary panel 107 is displaced inwardly towards the longitudinal axis of the container about 5.69 mm. Lesser amounts of such inward deflection of the primary panel 107 can be seen in the vicinity of region 1505, where there is virtually no inward deflection caused by the vacuum. Region 1510 exhibits an inward deflection of about 0.50 mm; region 1515 exhibits an inward deflection of about 1.00 mm; region 1520 exhibits an inward deflection of about 2.00 mm; and region 1525 exhibits an inward deflection of about 3.75 mm.

Meanwhile, the secondary panel 108 exhibits relatively less inward deflection, although more so than in FIG. 14A. FIG. 15B illustrates in greater detail the impact of vacuum upon such secondary panel 108 (e.g., there are regions 1525 and 1530 on the secondary panel 108 as shown in FIG. 15A). In the vicinity of the center point of region 1530, for example, the secondary panel 108 is displaced inwardly towards the longitudinal axis of the container about 4.75 mm to about 5.00 mm. Lesser amounts of such inward deflection of the secondary panel 108 can be seen in the vicinity of region 1505, where there is virtually no inward deflection caused by the vacuum. Region 1510 exhibits an inward deflection of about 0.50 mm; region 1515 exhibits an inward deflection of about 1.00 mm; region 1520 exhibits an inward deflection of about 2.00 mm; region 1525 exhibits an inward deflection of about 3.75 mm; and region 1527 exhibits an inward deflection of about 4.25 mm. Referring now to FIGS. 16A-16E, further details of the controlled radial deformation of the primary 107 and secondary 108 panels according to embodiments of the present invention will now be illustrated by way of FEA cross-sectional views through line B-B of the container shown in FIG. 1A under varying degrees of vacuum pressure.

Figure 16B:
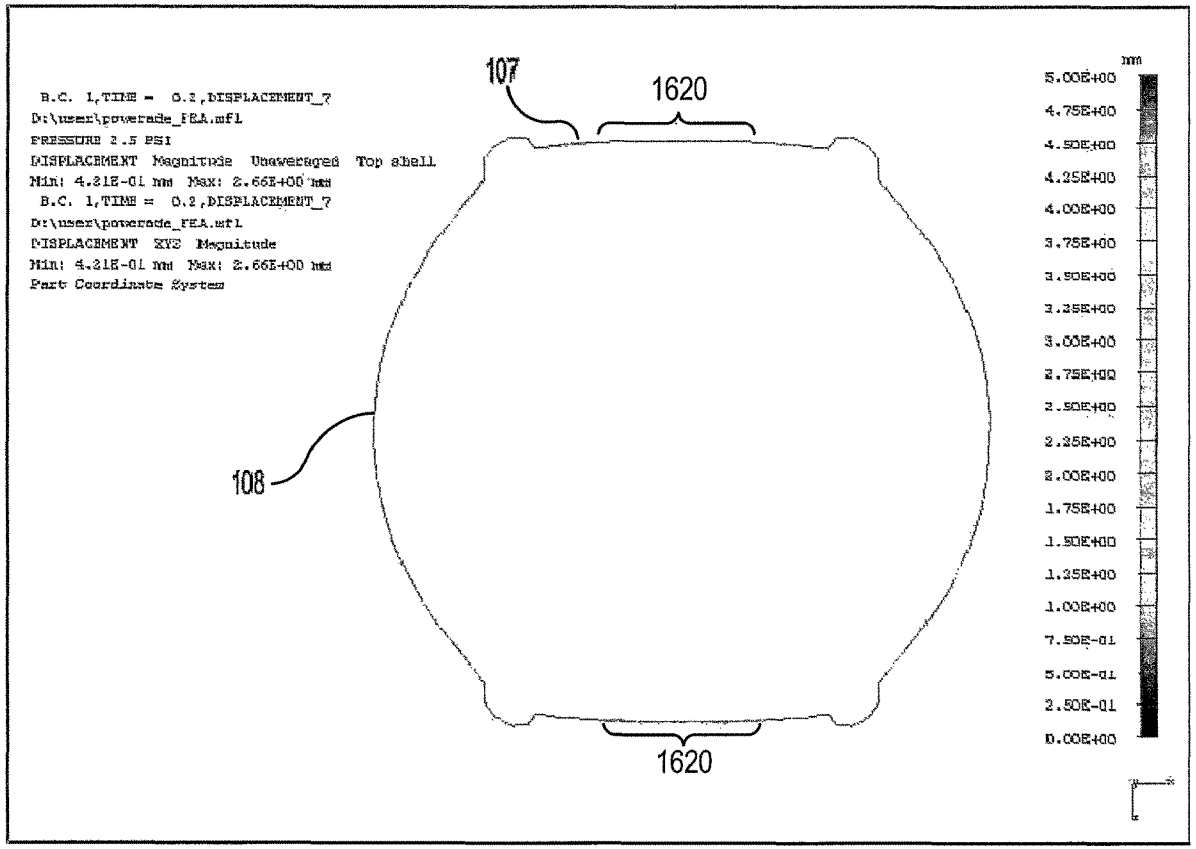

FIG. 16A illustrates the primary 107 and second 108 panels under about 0.250 PSI of vacuum. Both panels 107, 108 exhibit an outward curvature and little inward deflection (i.e., on the order 0.50 mm to about 1.00 mm) even when subjected to this vacuum. As shown in FIG. 16B, however, when the vacuum has increased to about 0.500 PSI, the primary panel 107 begins to exhibit a region 1620 of about 2.00 mm to about 2.50 mm inward deflection, while the secondary panel 108 deflects only 1.25 mm inwardly.

Figure 16C:
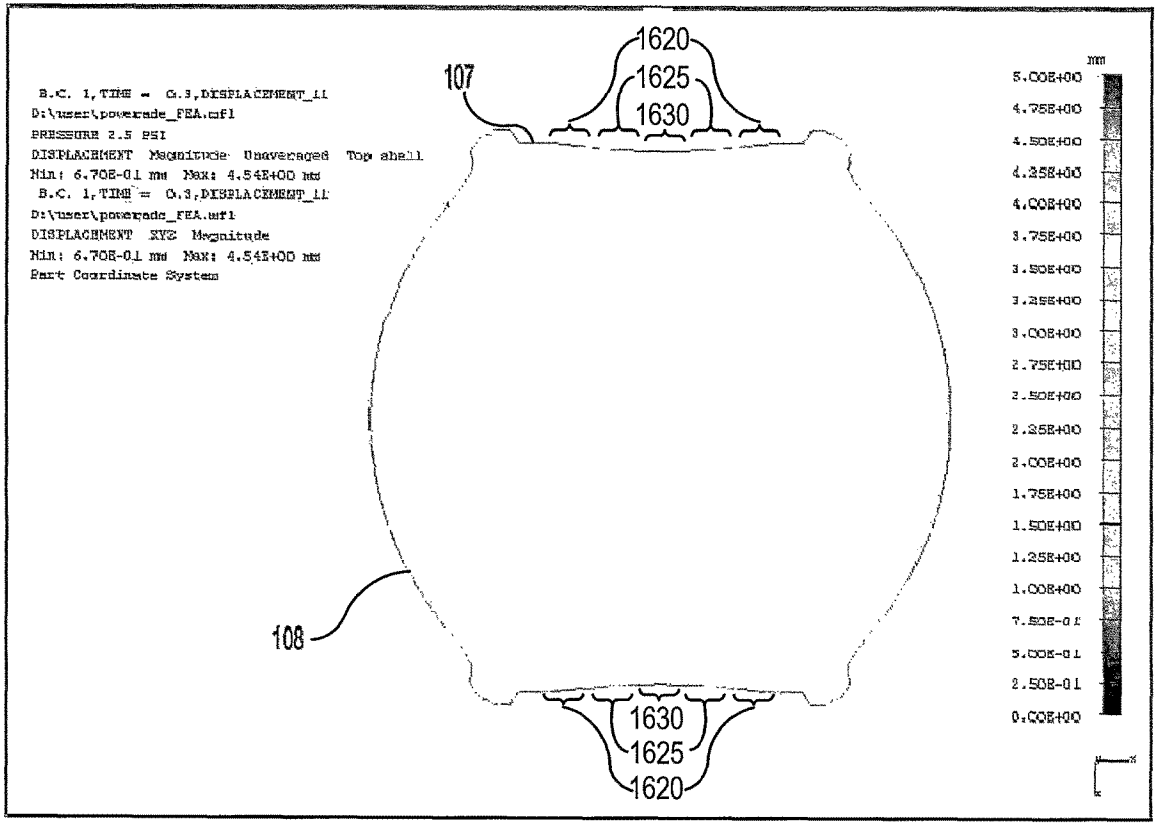

FIG. 16C further illustrates the continued inward deflection of the primary panel 107 under about 0.75 PSI vacuum. Regions 1620, 1625, and 1630 start to appear on the primary panels 107, indicating, respectively, about 2.00 mm to about 2.50 mm, 3.75 mm, and 4.00 mm to about 4.25 mm inward deflection. Meanwhile, the secondary panel 108 continues to exhibit only about 1.00 mm to about 2.00 mm inward deflection.

Figure 16D:
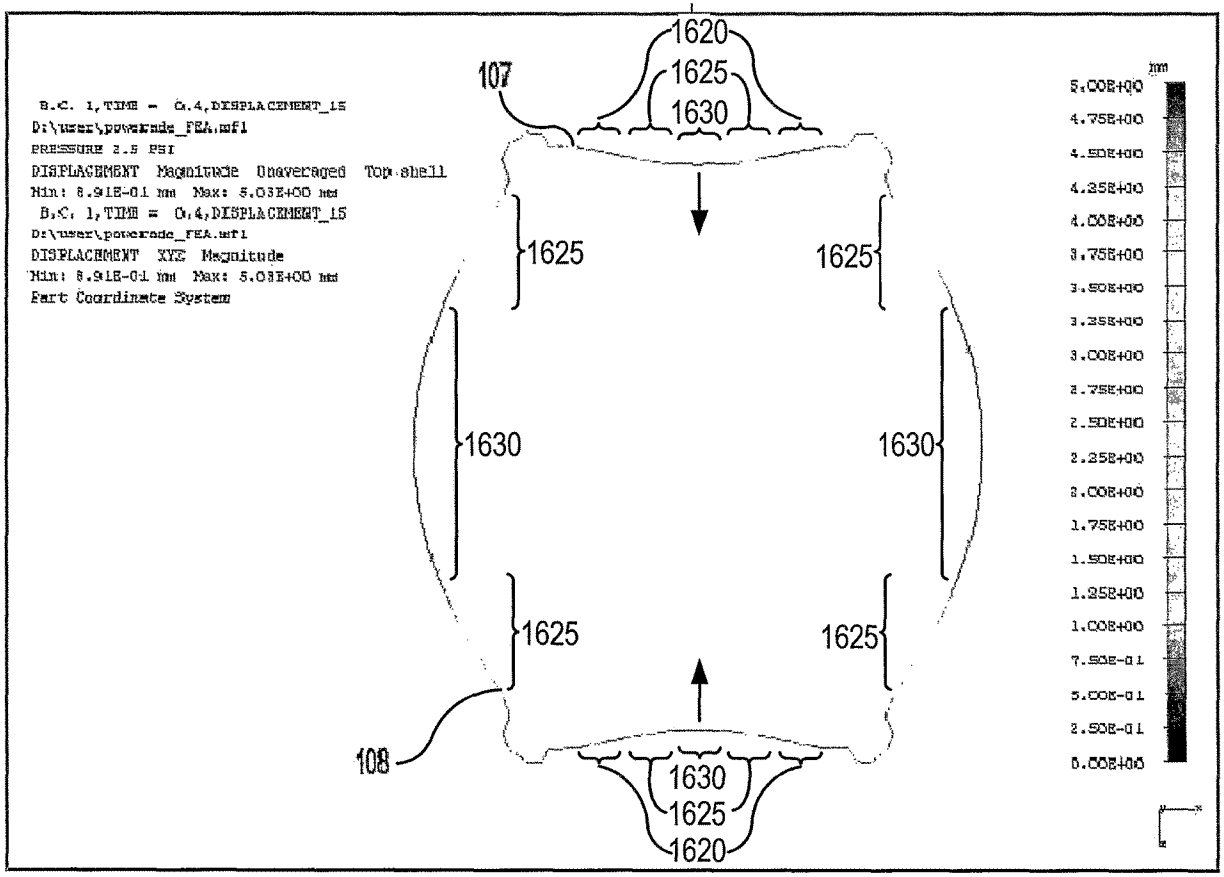
Figure 16E:
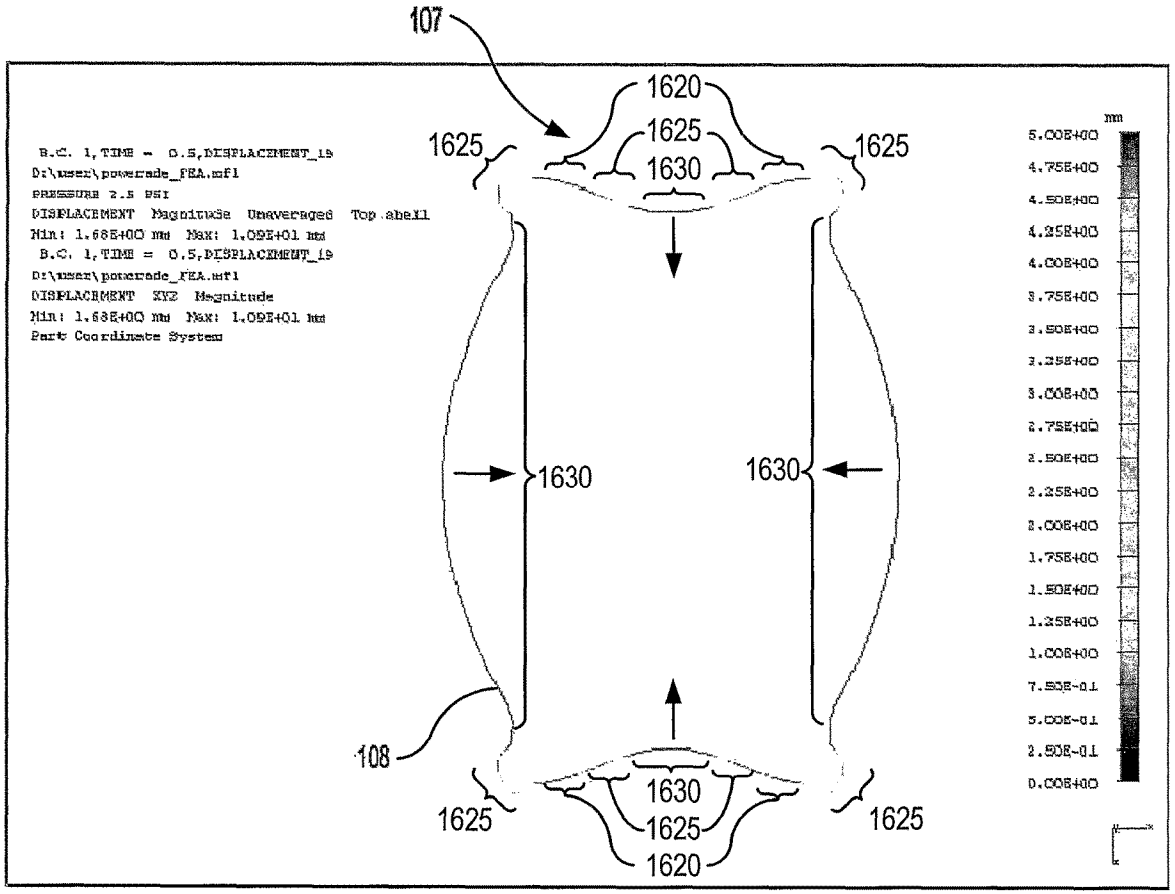

FIGS. 16D and 16E continue to illustrate the controlled radial deformation of the container under about 1.00 PSI and about 1.25 PSI vacuum, respectively. In FIG. 16D, it can be seen that the primary panel 107 has begun to invert, with regions 1620, 1625, and 1630 illustrating deflection in about the same amounts as shown in FIG. 16C. However, it can also be seen that the secondary panel 108 has begun to deflect inwardly at an increasing rate. Regions 1625 and 1630 start to appear on the secondary panels 108, indicating, respectively, about 3.75 mm, and about 4.00 mm to about 4.25 mm inward deflection. More importantly, it can be seen from FIG. 16E that substantially all of the secondary panels 108 have deflected inwardly about 4.00 mm to about 4.25 mm. The posts or vertical transition walls separating the primary panels 107 from the secondary panels 108 can also be seen to exhibit an inward deflection of about 3.75 mm. Thus, the primary 107 and secondary 108 panels provide flex and create leverage points at the posts or vertical transition walls for the panels 107, 108 to deflect. The primary 107 and secondary 108 panels flex in unison, but at differential rates.

As will be appreciated from the foregoing exemplary FEA, the cage structure comprising the primary 107 and secondary 108 vacuum panels and ribs (if any) cooperate to maintain container shape upon filling and cooling of the container. It also maintains container shape in those instances where the container might not have been hot-filled, bin subjected to vacuum-inducing changes (e.g., refrigeration or vapor loss) during the shelf life of the filled container.

The invention has been disclosed in conjunction with presently contemplated embodiments thereof, and a number of modifications and variations have been discussed. Other modifications and variations will readily suggest themselves to persons of ordinary skill in the art. In particular, various combinations of configurations of the primary and secondary panels have been discussed. Various other container features have also been incorporated with some combinations. The present invention includes combinations of differently configured primary and secondary panels other than those described. The invention also includes alternative configurations with different container features. For example, the indented portion 522 of the upper bumper wall 514 can be incorporated into other embodiments. The invention is intended to embrace all such modifications and variations as fall within the spirit and broad scope of the appended claims.

Unless the context clearly requires otherwise, throughout the description and the claims, the words "comprise", "comprising" and the like are to be considered in an inclusive sense as opposed to an exclusive or exhaustive sense, that is to say, in the sense of "including but not limited to".

The invention claimed is:

1. A container comprising a plastic body having a neck portion defining an opening, connected to a shoulder portion extending downward and connecting to a sidewall extending downward and joining a bottom portion forming a base, said sidewall including four panels, wherein said four panels are vacuum panels, and including vertical transitional walls disposed between and joining said panels, wherein said body is adapted to increase volume contraction and reduce pressure, and said panels are adapted to contract inwardly in response to internal negative pressure created during hot-fill processing and subsequent cooling of a hot liquid in said container; and wherein at least one of said panels is adapted for greater uptake of internal negative pressure than one other of said panels, wherein said panels comprise primary panels and secondary panels and wherein said primary panels comprise smaller surface area than said secondary panels;

and further wherein the container comprises horizontal transitional walls; wherein the secondary panels are recessed with respect to the horizontal transitional walls; and wherein said secondary panels include horizontal ribbings; wherein said horizontal ribbings are contiguous without being separated by intermediate regions, and further wherein said secondary panels are vertically arced.

2. The container of claim 1, wherein said primary panels and said secondary panels are opposing.

3. The container of claim 2, wherein the panels are convex, substantially flat or concave shaped and become less convex, substantially flat or more concave after contraction.

4. The container of claim 2, wherein the secondary panels are convex and become less convex or substantially flat after contraction.

5. The container of claim 2, wherein the primary panels are substantially flat and become concave after contraction.

6. The container of claim 2, wherein the primary panels are convex and become concave after contraction.

7. The container of claim 2, wherein said primary panels are adapted for greater uptake of internal negative pressure than said secondary panels.

8. The container of claim 2, wherein the primary panels comprise an upper and lower portion.

9. The container of claim 1, wherein the secondary panels comprise upper and lower panel walls.

10. The container of claim 1, further wherein the secondary panels are recessed with respect to the vertical transitional walls.

11. The container of claim 10, wherein an upper and lower bumper walls extend continuously along a circumference of the container.

12. The container of claim 10, wherein an upper and lower portions of said primary panel transition into said upper and lower bumper walls, respectively.

13. The container of claim 2, further comprising horizontal transitional walls defining upper and lower portions of said primary panel.

14. The container of claim 13, wherein said horizontal transitional walls extend continuously along a circumference of the container.

15. The container of claim 9, wherein said secondary panels include at least one horizontal ribbing.

16. A container comprising a plastic body having a neck portion defining an opening, connected to a shoulder portion extending downward and connecting to a sidewall extending downward and joining a bottom portion forming a base, said sidewall including at least a first and second pair of panels, wherein said first and second pair of panels are vacuum panels, and including vertical transitional walls disposed between and joining said first and second pair of panels, wherein said body is adapted to increase volume contraction and reduce pressure, and said first and second pair of panels are adapted to contract inwardly in response to internal negative pressure created during hot-fill processing and subsequent cooling of a hot liquid in said container; and further comprising upper and lower horizontal transitional walls, wherein the second pair of panels are recessed with respect the upper and lower horizontal transitional walls; and wherein said second pair of panels include horizontal ribbings; and further wherein said second pair of panels are vertically concave.

17. The container of claim 1, further comprising at least one recessed rib or groove between said sidewall and said shoulder portion and at least one recessed rib or groove between said sidewall and the bottom portion.

18. The container of claim 17, wherein said recessed rib or groove is continuous along a circumference of the container.

19. The container of claim 1, wherein the container is about an 8 to 64 ounce bottle.

20. The container of claim 1, wherein the shoulder and base are substantially round.

21. The container of claim 1 wherein a size of the secondary panels to the primary panels is selected from the ratio of 3:1, 2:1 or 7:5.

22. The container of claim 1, wherein a size of the secondary panels is 50% larger than the primary panels.

23. The container of claim 16, wherein said second pair of panels include three horizontal ribbings.

24. A container comprising a plastic body having a neck portion defining an opening, connected to a shoulder portion extending downward and connecting to a sidewall extending downward and joining a bottom portion forming a base, said sidewall comprising more than two vacuum panels, and including vertical transitional walls disposed between and joining said more than two panels, wherein said body is adapted to increase volume contraction and reduce pressure, and said panels are adapted to contract inwardly in response to internal negative pressure created during hot-fill processing and subsequent cooling of a hot liquid in said container; and wherein at least two panels of said more than two vacuum panels are adapted for greater uptake of internal negative pressure than one other of said vacuum panels, further wherein said at least two panels are vertically concave.

* * * * *